US008449415B2

(12) United States Patent
Grace

(10) Patent No.: US 8,449,415 B2
(45) Date of Patent: May 28, 2013

(54) MECHANICAL BROADHEAD

(75) Inventor: Nathaniel E. Grace, Port Huron, MI (US)

(73) Assignee: Grace Engineering Corp., Memphis, MI (US)

( * ) Notice: Subject to any disclaimer, the term of this patent is extended or adjusted under 35 U.S.C. 154(b) by 0 days.

(21) Appl. No.: 13/330,064

(22) Filed: Dec. 19, 2011

(65) Prior Publication Data

US 2012/0165142 A1 Jun. 28, 2012

Related U.S. Application Data

(60) Provisional application No. 61/426,159, filed on Dec. 22, 2010, provisional application No. 61/478,243, filed on Apr. 22, 2011.

(51) Int. Cl.
*F42B 6/08* (2006.01)

(52) U.S. Cl.
USPC ..... 473/583

(58) Field of Classification Search
USPC ..... 473/583, 584
See application file for complete search history.

(56) References Cited

U.S. PATENT DOCUMENTS

| | | | | |
|---|---|---|---|---|
| 2,993,697 | A | | 7/1961 | Urban |
| 3,138,383 | A | | 6/1964 | McKinzie |
| 4,099,720 | A | | 7/1978 | Zeren |
| 4,166,619 | A | | 9/1979 | Bergmann et al. |
| 4,579,348 | A | | 4/1986 | Jones |
| 4,973,060 | A | | 11/1990 | Herzing |
| 4,998,738 | A | | 3/1991 | Puckett |
| 5,066,021 | A | * | 11/1991 | DeLucia ..... 473/583 |
| 5,082,292 | A | | 1/1992 | Puckett et al. |
| 5,090,709 | A | | 2/1992 | Johnson |
| 5,102,147 | A | | 4/1992 | Szeluga |
| 5,112,063 | A | | 5/1992 | Puckett |
| 5,286,035 | A | | 2/1994 | Ward |
| 5,322,297 | A | | 6/1994 | Smith |
| 5,417,440 | A | | 5/1995 | Barrie et al. |
| 5,941,784 | A | | 8/1999 | Mizek |
| 6,174,252 | B1 | | 1/2001 | Mizek |
| 6,200,237 | B1 | | 3/2001 | Barrie |
| 6,270,435 | B1 | | 8/2001 | Sodaro |

(Continued)

OTHER PUBLICATIONS

New Archery Products Broadheads downloaded from http://www.newarchery.com/products/1/broadheads on Jan. 4, 2012.

(Continued)

*Primary Examiner* — John Ricci
(74) *Attorney, Agent, or Firm* — Warner Norcross & Judd LLP

(57) ABSTRACT

A mechanical broadhead including rearwardly deploying and/or sliding blades. The broadhead includes a ferrule defining a bore joined with a penetrating tip. A connector body, such as a carriage element or a pin, is slidably and moveably disposed within the bore, distal from the tip. One or more cutting blades is joined with the connector body. The connector body moves together in unison with the cutting blades as they expand from a retracted, in flight mode to a deployed, target penetrating mode. The connector body and blades can be joined with the ferrule so that the broadhead converts from a deployed mode to an unbarbed mode to facilitate broadhead removal. Optionally, the broadhead can include an internal retainer element that is resilient and durable enough to be used for multiple deployments. A related method of operating the broadhead also is provided.

27 Claims, 17 Drawing Sheets

U.S. PATENT DOCUMENTS

| | | | | |
|---|---|---|---|---|
| 6,283,880 | B1 | 9/2001 | Barrie | |
| 6,287,224 | B1 | 9/2001 | Liechty, II | |
| 6,290,903 | B1 | 9/2001 | Grace, Jr. et al. | |
| 6,398,676 | B1 | 6/2002 | Mizek | |
| 6,517,454 | B2 | 2/2003 | Barrie et al. | |
| 6,595,881 | B1 | 7/2003 | Grace, Jr. et al. | |
| 6,626,776 | B2 | 9/2003 | Barrie et al. | |
| 6,669,586 | B2 | 12/2003 | Barrie et al. | |
| 6,749,801 | B1 | 6/2004 | Grace, Jr. et al. | |
| 6,910,979 | B2 | 6/2005 | Barrie et al. | |
| 6,935,976 | B1 | 8/2005 | Grace, Jr. et al. | |
| 6,942,588 | B2 | 9/2005 | Barrie | |
| 6,997,827 | B1 | 2/2006 | Grace, Jr. et al. | |
| 7,013,772 | B1 | 3/2006 | Grace, Jr. et al. | |
| 7,182,706 | B2 | 2/2007 | Barrie | |
| 7,226,375 | B1 | 6/2007 | Sanford | |
| 7,234,220 | B1 | 6/2007 | Grace, Jr. | |
| 7,314,419 | B2 | 1/2008 | Grace et al. | |
| RE40,273 | E | 4/2008 | Grace, Jr. et al. | |
| 7,708,659 | B2 | 5/2010 | Grace, Jr. | |
| 7,713,152 | B1 * | 5/2010 | Tentler et al. | 473/583 |
| 7,717,814 | B1 * | 5/2010 | Sanford | 473/583 |
| 7,771,298 | B2 | 8/2010 | Pulkrabek | |
| 7,951,024 | B2 | 5/2011 | Mizek | |
| 8,043,177 | B2 * | 10/2011 | Flanagan | 473/583 |
| 8,182,378 | B1 * | 5/2012 | Futtere | 473/583 |
| 2009/0203477 | A1 * | 8/2009 | Mizek et al. | 473/583 |

OTHER PUBLICATIONS

Grim Reaper Broadhead Assembly downloaded from http://www.youtube.com/watch?v=mlpechah4rc on Dec. 21, 2011.

Tekan II Broadhead downloaded from http://www.sportsmansguide.com/net/cb/g5-tekan-ii-100-gr-broadhead.aspx?a=277261 on Jan. 6, 2012.

* cited by examiner

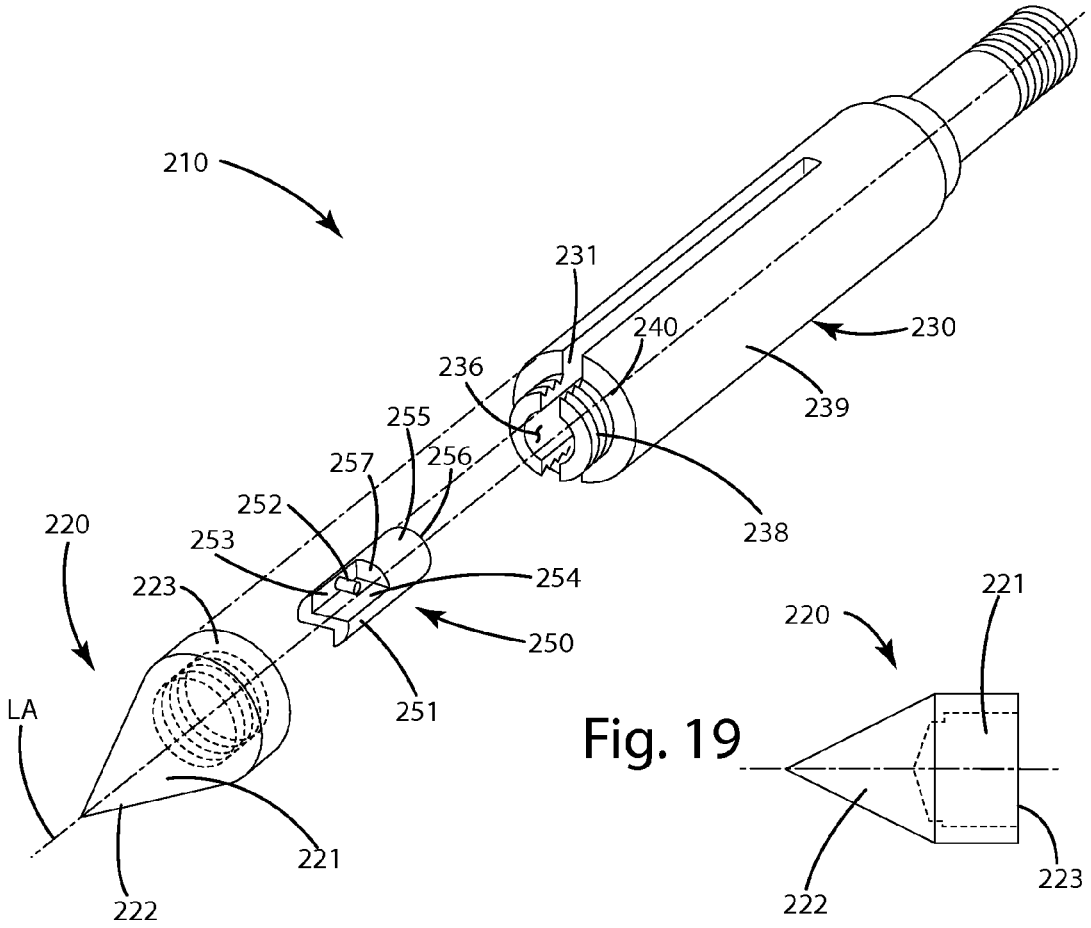
Fig. 19
Fig. 22
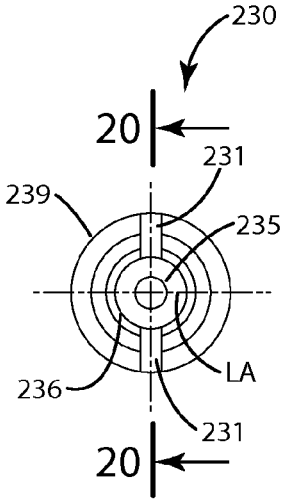
Fig. 21
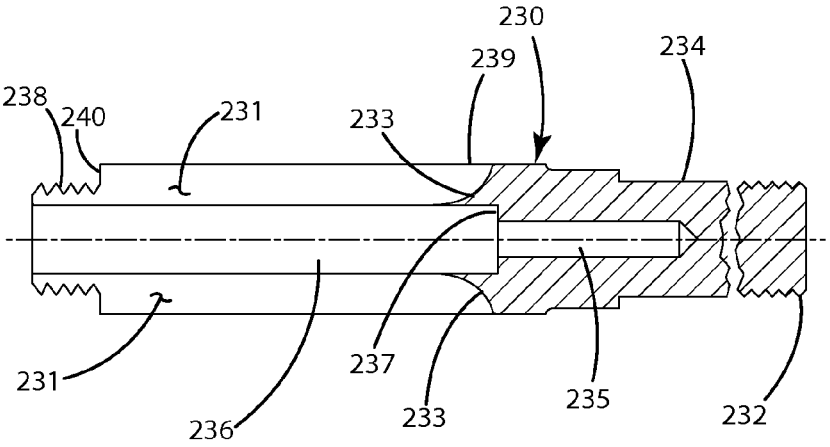
Fig. 20

MECHANICAL BROADHEAD

BACKGROUND OF THE INVENTION

The present invention relates generally to a mechanical broadhead, and more particularly, to a mechanical broadhead including rearward deploying and/or sliding blades.

A mechanical broadhead, sometimes referred to as an expanding blade broadhead, includes blades joined with a ferrule so that the blades can move from a retracted in-flight position to a deployed on-impact position. Mechanical broadheads generally have the flight characteristics of a field point, yet the penetration and cutting characteristics of a fixed blade broadhead.

One type of mechanical broadhead is a pivoting blade broadhead. This broadhead includes blades located in a slot defined by a ferrule so that the cutting edges of the blades face inward in the retracted, in-flight position. The blades are pivotally joined with the ferrule at their rear so they can rotate from the retracted, in-flight position to a deployed position on impact with the target. In the deployed position, the cutting edges of the blades face outward so that they can enhance penetration and cutting action. Pivoting blade broadheads, however, require substantial kinetic energy for blade rotation, which results in less energy remaining for target penetration.

Another type of mechanical broadhead is a rearward deploying broadhead. These broadheads come in many configurations. In one configuration, blades are disposed in a groove defined by a ferrule so that the cutting edge of the blades face outward. The blades also each define a lost motion slot through which a pin extends to movably join the blades with the ferrule. Each blade is disconnected from the other, and accordingly the blades move independently of one another. The pin is fixedly and immovably joined with the ferrule. On impact, the blades slide rearwardly, with the slot moving relative to the fixed pin, generally through a range of motion defined by the slot, until the blades achieve a deployed position. The interaction of the pin journaled and moving generally linearly in the lost motion slot, along with the blade engaging a rearward portion of a ferrule groove, results in the blades camming outwardly to the deployed position.

A completely different configuration of rearwardly deploying mechanical broadheads includes blades having projections, for example, bosses, positioned on opposite sides of the blades. These projections move in channels defined by the ferrule, and help define the opening path of the blades in conjunction with the blades engaging a washer, generally positioned at the rear of the ferrule.

Yet another type of rearwardly deploying mechanical broadhead includes blades that are disposed in a groove defined by a ferrule so that the cutting edge of the blades face outward. The blades are all joined at their ends with a common single circular ring that is translatably positioned in a channel defined by the ferrule. Thus, all the blades are connected to one another via the circular ring. On impact, the blades and the ring slide rearwardly until the blades achieve a deployed position. Sometimes, however, the ring does not move smoothly within the channel, which can cause the blades to move and deploy irregularly, or not deploy at all.

Mechanical broadheads have advantages over fixed ferrule broadheads, and rearwardly deploying and/or sliding blade mechanical broadheads provide similar advantages over their pivoting blade counterparts.

SUMMARY OF THE INVENTION

A mechanical broadhead including rearwardly deploying and/or sliding blades is provided. The broadhead includes a ferrule defining one or more ferrule slots, blades which are disposed and move within the slots, and a common connector body, such as a carriage element or a pin, connecting the blades, where the connector body moves together with the blades as they expand optionally in unison from a restricted mode to a deployed mode. This configuration optionally can reduce the complexity of a mechanical broadhead and can provide a broadhead with a larger cutting diameter.

In one embodiment, the broadhead can include a ferrule defining a bore, a penetrating tip, also referred to as a broadhead point, joined with the ferrule, and at least two blades linked together by a common connector body so that the blades move together rearwardly as a unit, and generally in unison. The connector body can retain the blades in the ferrule in both static and dynamic configurations. Optionally, while moving together as a unit, the blades can pivot relative to one another and about the connector body and/or a portion thereof, such as a carriage pin.

In another embodiment, the connector body can be registered with features of the ferrule so that it moves along a preselected path, which in turn guides the blades at least partially along the path because the blades and connector body move with each other. The ferrule can define a compartment or bore, and one or more connector body guide channels or grooves, defined outwardly from the compartment, within which the connector body registers. For example, two channels can extend along an internal portion of the ferrule, such as an internal wall of a bore, and can be diametrically opposed to each other. The connector body can be in the form of a pin that is registered in one or both of the channels, and can be constrained in movement by the channels so that the pin is effectively guided by the channels.

In still another embodiment, the connector body can be in the form of a carriage element, which can include a generally elongated body that registers and is slidably received in the bore defined by the ferrule. The carriage elements and its elongated body, can include opposing carriage element parts that join with one another. The carriage element can include first and second pins that facilitate joining of the respective first and second blades to the carriage element. The pins can project through corresponding holes defined in the respective blades, and the blades can pivot about those pins.

In still yet another embodiment, the carriage element parts can each include respective first and second pins. These pins can register within corresponding pin holes defined in the other of the carriage element parts to generally join the parts together. The outer surfaces of the carriage element parts collectively can be of the same general geometric shape as the interior of the bore defined in the ferrule so that the carriage element fits and moves freely within the bore, optionally within the interior wall(s) of the bore. For example, when combined, the carriage element parts can form a somewhat cylindrical elongated body, which can fit and move effectively within a corresponding cylindrical bore of the ferrule. If desired, however, certain portions of the elongated body can be removed to lighten the carriage element, in which case the outer surfaces of the carriage element would not precisely match the geometric shape of the bore, yet would still be able to move freely and slide within it.

In yet another embodiment, the ferrule can define two or more ferrule slots, generally parallel to the plane of a longitudinal axis of the ferrule. The ferrule slots can extend from an outer surface of the ferrule inward to an internal portion of the ferrule, which can be in the form of a compartment or bore defined by the ferrule. Optionally, the ferrule slots can be offset from one another on opposite sides of a central plane passing through a longitudinal axis of the ferrule, and further optionally adjacent or within the central plane passing through the longitudinal axis of the ferrule.

In still another embodiment, the ferrule slots can be separate from the connector body guide channels with which the connector body is registered. Accordingly, the combined blade/connector unit can be guided by two mechanisms, for example, the connector body moving or sliding within the guide channels and/or the bore, and the blades moving in their respective ferrule slots.

In even another embodiment, the blades can include connector portions at which the connector body connects the blades to one another. The connector portions of the blades can overlap one another so that one side surface of one blade overlaps and is in contact with a side surface of another blade.

In still even another embodiment, the connector body can be in the form of a carriage element defining a carriage void. The carriage element can be slidably positioned in a bore of the ferrule, separate and disconnected from a penetrating tip also joined with the ferrule. The connector portions of the blades can be positioned in the void, and can define apertures that align with one another in the void. A carriage pin can project through the void and the aligned apertures to pivotally mount the blades to the carriage element. Optionally, the blade apertures are configured so that the blades can only pivot or rotate relative to the carriage pin, but cannot slide or otherwise move relative to this pin.

In still another embodiment, a method is provided for operating a mechanical broadhead. In the method, upon engagement with the target, the blades can move from a retracted mode to an expanded mode on a path defined by the connector body, for example a pin or a carriage element, traveling rearward in the channels defined in the internal compartment of the ferrule, or generally within the bore of the ferrule. The blades can pivot about the pin and relative to one another, optionally without sliding relative to the pin during the rearward travel. The blades can be guided or maintained in an orthogonal or other configuration relative to the ferrule by riding in ferrule slots defined by the ferrule.

In an even further embodiment, the connector body and blades can be coupled to the ferrule so that the blades are translatable from the deployed mode to an unbarbed mode to facilitate removal of the broadhead from a target.

In still a further embodiment, a surface on a stem joined with or part of the ferrule engages the inner edges of the blades, in their rearward travel, causing them to move outward until they are fully extended. Optionally, the blades can define a stop notch to limit rearward movement and/or expansion of the blades.

In yet another embodiment, a method is provided for expanding a mechanical broadhead. In the method, upon engagement with the target, the blades can move from a retracted mode to an expanded mode on a path at least partially defined by a carriage element moving within a bore of the ferrule. The carriage element can move rearward within the ferrule bore, generally away from a penetrating tip of the broadhead. The blades can pivot about a carriage pin joined with the carriage element, optionally without sliding relative to the pin, but pivoting relative to one another during the rearward travel.

These and other objects, advantages and features of the invention will be more readily understood and appreciated by reference to the detailed description of the current embodiments and the drawings.

BRIEF DESCRIPTION OF THE DRAWINGS

FIG. 19 is a perspective front view of a second alternative embodiment of the broadhead;

FIG. 20 is a cross-sectional side view of a ferrule of the second alternative embodiment of the broadhead;

FIG. 21 is front view of the ferrule;

FIG. 22 is a side view of a point of the second alternative embodiment of the broadhead;

DETAILED DESCRIPTION OF THE CURRENT EMBODIMENTS

Figure 1:
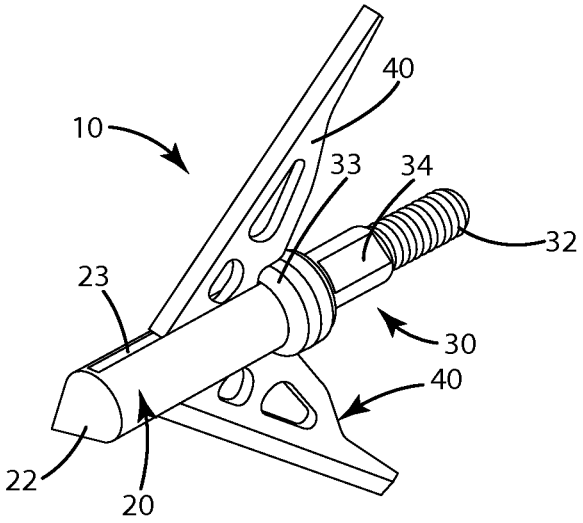
FIG. 1 is a perspective view of a broadhead of a current embodiment with the blades in a fully open or deployed mode.

A current embodiment of the broadhead is shown in FIGS. 1-8 and generally designated 10. The broadhead 10 can include a ferrule 20, a stem 30, and two or more blades 40 connected by a connector body, which is shown as a common pin 50. For purposes of a disclosure, the broadhead is described in connection with use on an archery arrow; however, the broadhead is well suited for use with any projectile.

As shown in FIGS. 1-4, which illustrate the broadhead 10 with the blades 40 in a fully open mode, expanded or deployed mode, the ferrule 20 can be a generally cylindrical and/or elongated body. Of course, it can come in a variety of other geometric shapes. For example, it can be elliptical, square, triangular or have other cross sections as desired. The forward end of the ferrule 20 can include a penetrating tip or point 22 that can be either integral or detachable from the ferrule, and can come in a variety or configurations. Where the tip 22 is detachable, it can be secured to the ferrule 20 by mating threads or other suitable fastener constructions. The shape of the tip 22 can be conical, or it can include a trocar tip, or it can include replaceable individual blades.

Figure 2:
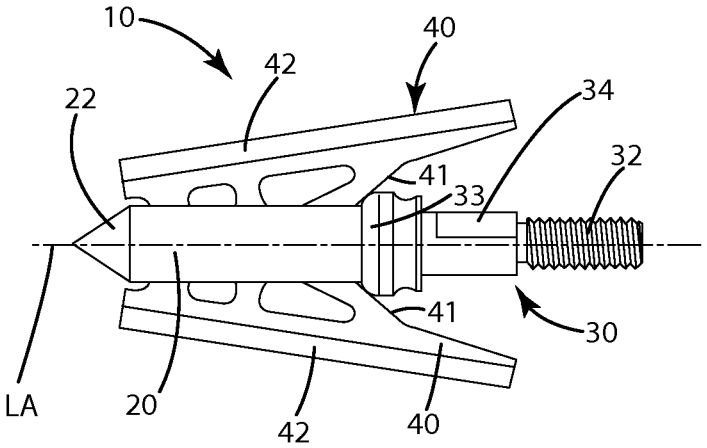
FIG. 2 is a side view of the broadhead with the blades in a fully closed or retracted mode.

The ferrule 20 can include an end 21 which is configured to join with a stem 30. The stem can be integral with or detachable from the remainder of the ferrule. For example, referring to FIGS. 4 and 6, the forward end of the stem 30 can be provided with an internal thread 31 adapted to engage a mating external thread 21 on the rearward end of the ferrule 20 to connect these components. As shown in FIGS. 1 and 2, the outer periphery 33 at the forward end of the stem 30 can be contoured to include a camming or other surface 44 to engage the surfaces of the inner edges 41 of the blades 40. With this engagement, the blades 40 can move outward as they move rearward from the point upon engaging a target. The camming surfaces 44 can be configured to engage the inner edges in a preselected manner and move the blades on a preselected expansion path.

At its opposite end, the stem 30 can be configured with a thread 32 for engagement with another thread defined by an arrow insert (not shown) so that the stem, and therefore the attached ferrule and other components can be joined with an arrow (not shown). Wrench flats 34 can be provided on the stem component 30 for ease of attachment to the ferrule 20 and to the arrow insert (not shown).

Figure 5:
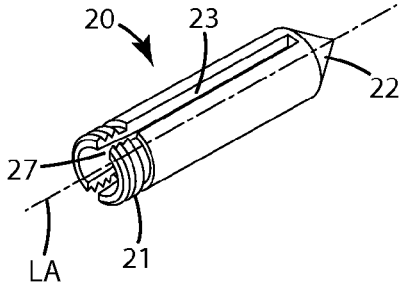
FIG. 5 is perspective view of a ferrule of the broadhead showing ferrule slots and a threaded rear portion.
Figure 6:
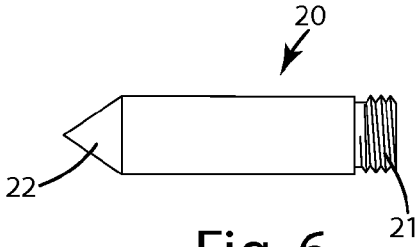
FIG. 6 is a side view of the ferrule.
Figure 7:
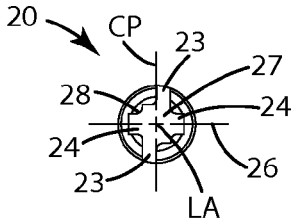
FIG. 7 is an end view of the ferrule showing the offset position of the ferrule slots and the internal channels that accommodate a connector body.

As shown in FIGS. 5 and 7, the ferrule 20 can define an internal compartment or bore 27. The bore 27 can extend along the length of the ferrule 20, generally from the point to where the ferrule joins with the stem. The bore 27 can be bounded by an internal wall 28, which can further define connector body guide grooves or channels 24. The channels 24 generally can be parallel to the longitudinal axis LA of the ferrule 20, and can extend for a major portion of its length, and terminate at the rearward end of the ferrule 20. The channels 24 can be diametrically opposed to one another across the internal bore 27 of the ferrule, and can be sized to accommodate portions of the connector body 50. For example, where the connector body is in the form of a pin 50, the channels 24 can be defined in the internal wall 28 of the ferrule and sized to receive one or both ends of the pin. The channels can be dimensioned slightly larger than the ends of the pin so that those ends can slide or generally move relative to the channels 24. As illustrated, the pin ends can move and slide within the channels. Where the pin ends move within the channels 24, the channels operate to guide and generally define the path along which the connector body, and therefore the blades, move.

Figure 3:
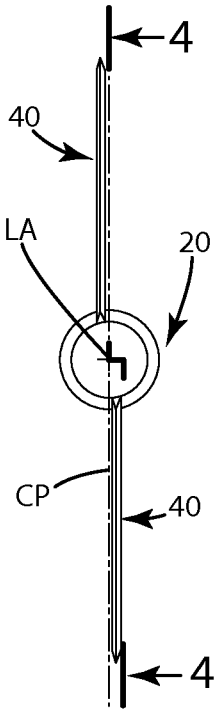
FIG. 3 is a front view of the broadhead showing the offset of the blades in relation to a central plane of the broadhead.

In addition to the internal compartment or bore 27 and the connector body channels 24, the ferrule 20 can define one or more ferrule slots 23. The ferrule slots, as shown in FIGS. 3, 5 and 7 generally can be offset relative to one another and offset relative to the longitudinal axis LA of the ferrule 20. As shown in FIGS. 3 and 7, the two offset slots 23 for the blades 40 are located adjacent to a central, generally vertical plane CP that is coincident with the longitudinal axis LA of the ferrule and perpendicular to the centerline 26 of the connector body channels 24.

The ferrule 20 can be manufactured from metal such as, but not limited to, aluminum, stainless steel, or titanium, or formed from a suitable composite material. If the material chosen is metal, it can be machined from bar stock or formed using the metal injection molding (MIM) process followed by secondary machining operations. If a composite material is chosen for the ferrule 20, the tip 22 optionally can be manufactured separately and from a more durable material such as steel or titanium. The stem 30 can be manufactured from similar materials and processes as the ferrule 20.

Optionally, the broadhead can be void of any biasing elements, such as springs, that might urge the blades in a rearward direction for deployment to a deployed mode. Instead, all the rearward movement of the blades can be derived from forces imparted on the blades upon engagement of the blades with a target. Of course, if biasing elements are desired in some applications, they can be included.

Figure 8:
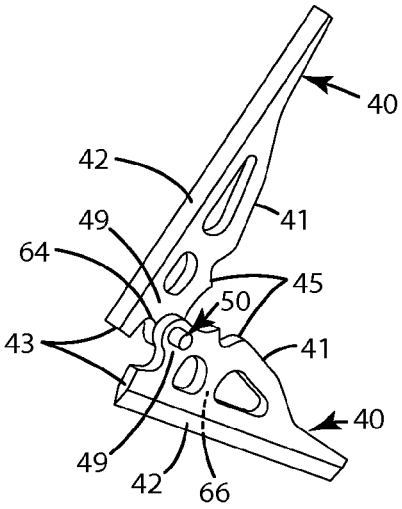
FIG. 8 is a perspective view of two blades in an expanded mode with a connector body joining the blades.

As shown in FIG. 8, the blades 40 can be joined by and with the connector body, which is shown as a straight, linear pin 50. This pin, as noted above, can include opposing ends that engage the optionally diametrically opposed internal channels 24 in the ferrule 20 as best seen in FIG. 7. The pin can also be sized to closely fit through the holes 62 defined by the respective blades. Generally, the holes and pin can be sized so that the blades can pivot about the pin without a significant moment having to be exerted for the rotation of a blade relative to the pin.

Although shown as in the form of a cylindrical pin, the connector body can be of a variety of other geometric shapes that allow the blades to pivot relative to one another. For example, the connector body can be in the form of a pin of a rectangular or elliptical configuration, with the holes 62 in the blades of a sufficient size to allow the pin to rotate relative to the blades or vice versa. As another example, the connector body 50 can be an integral part of one of the blades, like a boss, which is any type of projection, and can fit through a hole defined in the other blade to provide the relative pivoting of one blade to another, while still allowing the pin to be guided by the connector guide channels 24. In such a construction, the pin 50 can extend from both opposing sides of a blades, and can optionally extend farther on one side than the other, so the longer side of the boss can fit through a hole defined by the other blades to accommodate it. As yet another example, the connector body can be in the form of a carriage, as described in the alternative embodiments below.

In the broadhead shown in FIGS. 4, 8 and 9-10, each blade can include a leading or forward edge 43 that can be sharpened to cut on contact when engaging a target. The blades can include an upper cutting edge 42 with serrations 47 at its proximate end to increase resistance upon engagement with a target and enhance the rearward movement of the blades 40 to the fully open position as illustrated in FIGS. 1-4. The blades can also include a locking notch 45 which engages the surface 44 to limit or cease rearward movement and/or radially outward deployment, of the blades. The notch 45 can be defined in the blade adjacent the inner edge 41 of the blades.

The blades 40 can include connector portions 49 at which the connector body 50 connects the blades to one another. Generally, the connector portions define the holes 62 within which the pin 50 fits. As shown in FIG. 8, the connector portions 49 of the blades can be side by side one another, and optionally can overlap one another so that one side surface 64 of one blade overlays and is in contact with an opposing side surface 66 of another blade.

As further shown in FIG. 3, the ferrule can define a central plane CP that generally bisects the ferrule. The central plane CP can be aligned with and parallel to the longitudinal axis LA of the broadhead 10. If desired, the longitudinal axis can lie within the central plane CP. The blades 40 can be positioned on opposite sides of the central plane CP. If desired, the one or both of the blades can lie within the central plane, depending on the application and the clearance afforded to the respective blades to allow them to move as described herein.

Figure 9:
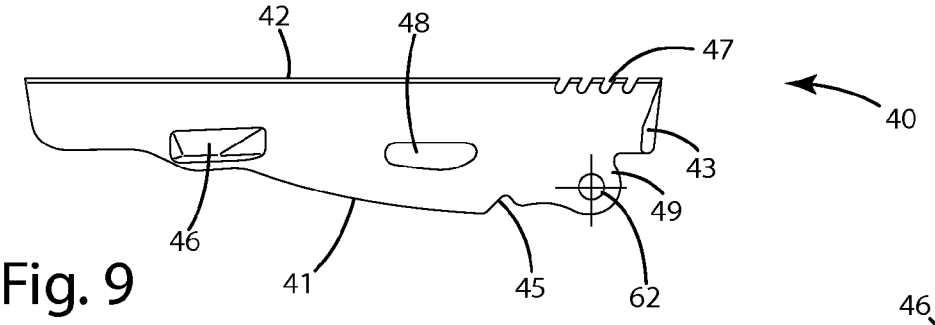
FIG. 9 is a side view of a single blade.
Figure 10:
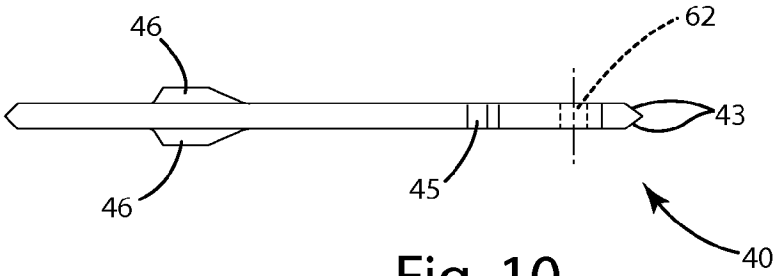
FIG. 10 is a top view of the single blade.

Optionally, as shown in FIG. 9, openings 48 in the web of the blade 40 can be provided, the number and shape of which can vary as desired. The outer surfaces of the web area of the blade 40, or optionally its inner edge 41, proximate its distal end can be configured to include a retainer element which holds the blade in a retracted or non-expanded configuration. As shown in FIGS. 9 and 10, tabs 46 are provided on opposite sides of the web for engagement with a spring clip (not shown) for blade retention and maintaining the broadhead in a retracted mode while in flight.

The blades 40 can be made from a material that is capable of providing and maintaining a very sharp edge, for example, high carbon steel, titanium, or other metals. The blades can be formed by stamping, fine blanking, metal injection molding (MIM), or similar processes with subsequent heat treating, grinding, and honing operations.

In flight, the blades 40 of the broadhead 10 are in a retracted mode with their cutting edges 42 generally parallel to the longitudinal axis LA (FIG. 2), thereby reducing frontal area and minimizing aerodynamic drag. Again, the blades 40 can be retained in the retracted position during flight by means of spring clips, O-rings or similar devices (not shown).

Figure 4:
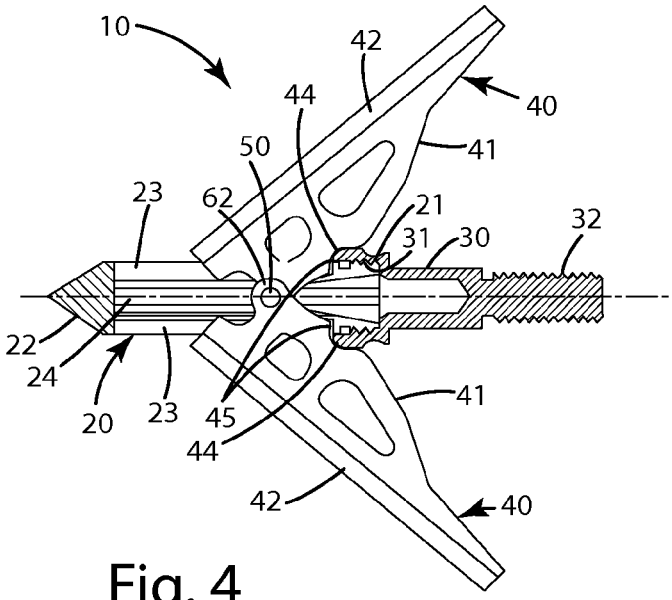
FIG. 4 is a sectional view of the broadhead showing the location of the blades in the ferrule slots when fully open.

In operation, the resistance encountered when the broadhead 10 engages a target can force the blades 40, connected by the pin 50, to move together as a unit in unison (rather than independently) in a rearward direction from a retracted mode to a deployed mode. The blade path can be dictated in part by the connector body 50 being guided within or relative to the connector guide channels 24 in the ferrule 20, guiding of the blades 40 within the ferrule slots 23, as well as the engagement of the inner edge 41 with the surface 44. As the inner edges 41 of the blades 40 encounter the peripheral surface 44 of the stem 30, the blades 40 can be forced outward until the end point in the rearward movement is reached, at which point the fully expanded or deployed mode of the broadhead is achieved. The notch 45 configured adjacent the inner edge 41 of the blade 40 can be coincidental with the point of maximum rearward travel to lock the blades 40 in the deployed mode as shown in FIGS. 1 and 4.

The broadhead 10 can be assembled by joining the two blades 40 with the pin 50. The front portion of the blades 40 can be positioned in their respective slots 23 at the rear of the ferrule 20 and slid forward to register the ends of the pin 50 in the connector body guide channels 24 defined by the ferrule 20. As the ends of the pin register and move in the channels 24, the connector portions 49 can move within the internal bore 27 of the ferrule. In addition, the blades themselves slide within the respective ferrule slots 23.

With the blades 40 and connecting pin 50 positioned in the ferrule 20, the stem 30 can be attached to the rear of the ferrule 20 by engaging the threads 31 of the stem 30 with the mating threads 21 of the ferrule 20. The wrench flats 34 provided on the stem 30 can be used to tighten and thereby secure the stem 30 to the ferrule 20. A retention device, such as an O-ring or metal clip, can be joined with the broadhead 10.

For the embodiment of the blade 40 shown in FIGS. 9 and 10, a retainer element, such as a retention clip, can be used. After the retention clip is positioned on the stem 30, the blades 40 can be moved forward to a retracted mode allowing the retention clip to engage the tabs 46 on the sides of the web of each blade 40.

With the broadhead 10 assembled, it can be attached to the arrow. If desired, the wrench flats 34, provided on the stem 30, can be utilized to fasten the broadhead 10 to an arrow insert.

First Alternative Embodiment

Figure 11:
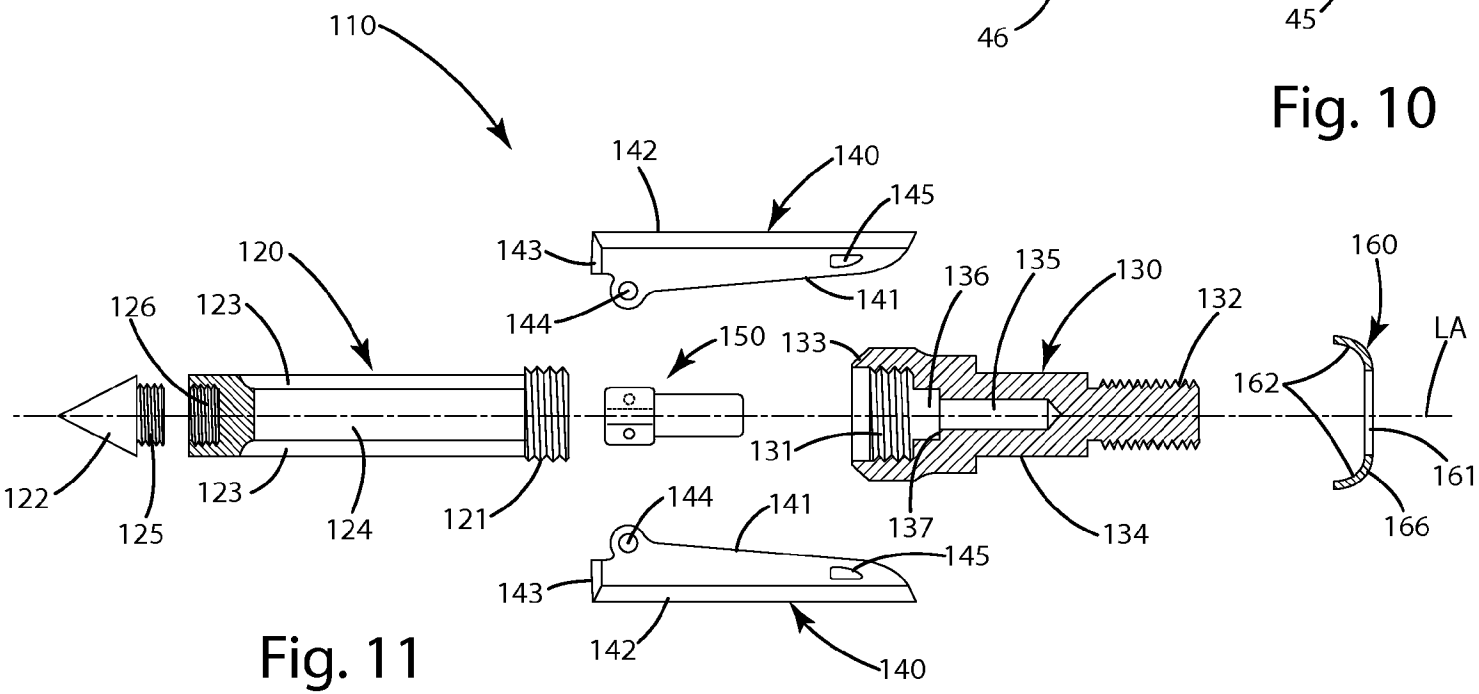
FIG. 11 is an exploded view of a first alternative embodiment of the broadhead.
Figure 12:
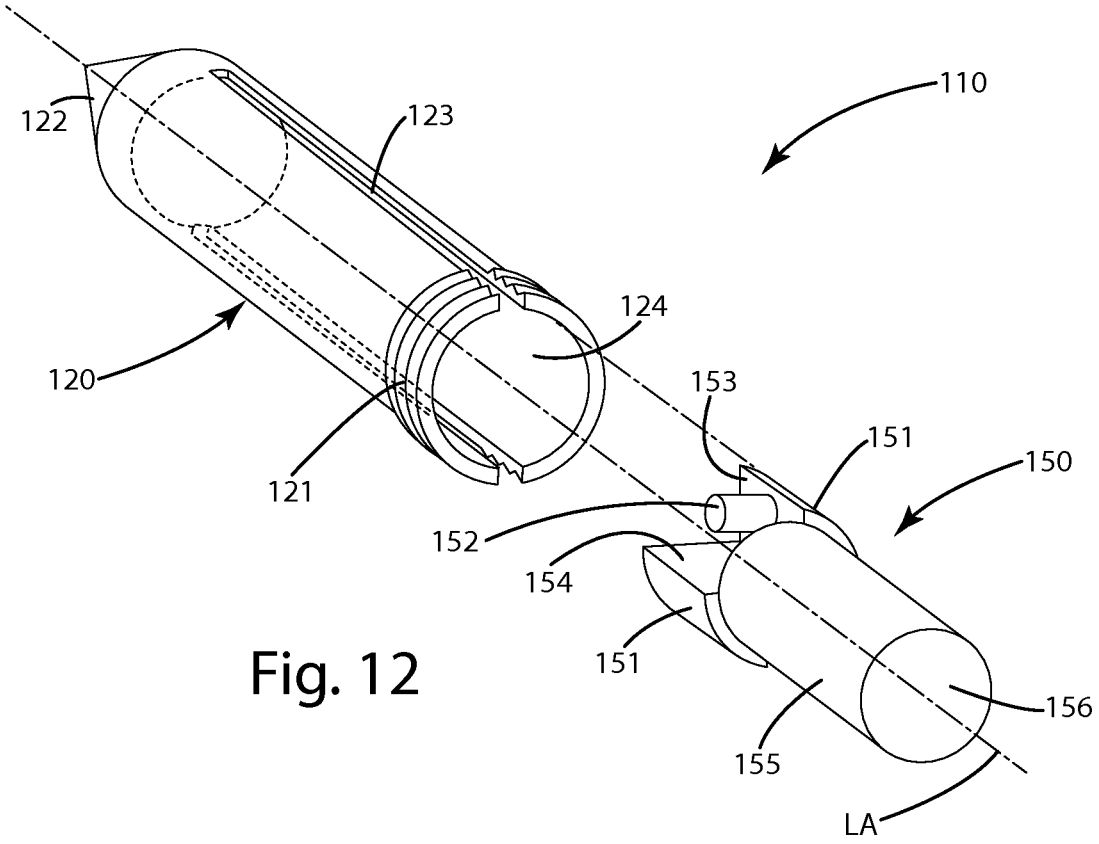
FIG. 12 is another perspective exploded view of the first alternative embodiment of the broadhead.

A first alternative embodiment of the broadhead is illustrated in FIGS. 11-18 and generally designated 110. This embodiment is similar to the above embodiment in structure and operation with several exceptions. For example, the ferrule body 120 can be joined with a detachable stem 130, and blades 140 can be joined with the ferrule via connector body 150. As shown in FIG. 12, however, the connector body 150 can be a generally cylindrical body, including, for example, a partially circular cross section. Of course, if desired, the cross section of the connector body 150 can be of other geometric shapes, for example, it can be square, rectangular, elliptical, polygonal or of other shapes.

The major diameter or dimension of the connector body 150 can be sized to fit within the bore 124 defined by the ferrule body 120. Optionally, the inner dimension or diameter of the bore 124 can be slightly greater than the dimensions or circumference of the external surface 151 of the connector body 150 so that the body is adapted to slide or otherwise move within the bore. Further, optionally, the connector body can have a length along the longitudinal axis LA of the ferrule 130 that is greater than the width of the connector body transverse to that axis. This configuration can stabilize the movement of the body in the bore, and also can stabilize movement of the blades.

In operation, the blades are in a retracted mode in flight, but begin to deploy rearwardly when the broadhead engages the target. As the blades 140 expand upon engagement with a target, the blades first begin to move rearward, and in so doing, the connector body 150 joined with the blades 140 slides rearward in the bore 124 of the ferrule body 120. Lateral movement of the blades is restricted by slots 123 in ferrule 120 that extend from the surface of the bore 124 through the outer periphery of the ferrule 120. As the inner edges 141 of the blades 140 encounter the peripheral surface 133 of the stem 130, the blades 140 are forced outward until the end point in the rearward movement or deployment is reached, at which point the fully expanded mode of the broadhead 110 is achieved.

Figure 13:
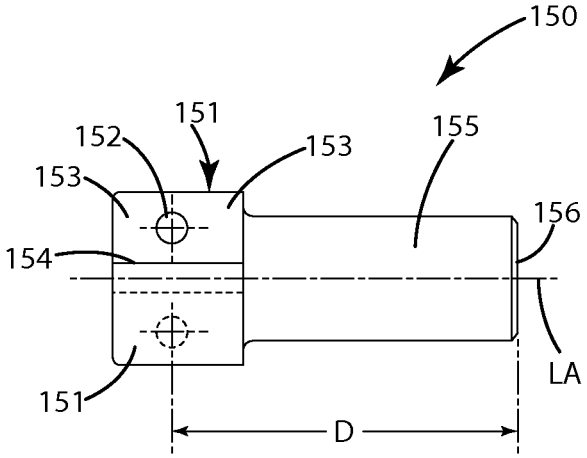
FIG. 13 is a side view of an alternative connector body for a two bladed version of the first alternative embodiment.

As further shown in FIGS. 12-18, a generally cylindrical rear portion of the connector body 150 defines a peripheral surface 155 and an end surface 156. Referring to FIGS. 11 and 12, the diameter of the peripheral surface 155 is sized to fit moveably within the bore 136 in the stem 130. The connector body 150 can also be configured to define a distance D, which extends from the connector pivot pins 152, for example, their center points, to the end surface 156 (FIG. 13). This distance D can be preselected to selectively restrict the rearward travel of the blades 140. This can enable the blades 140 to achieve the maximum desired opening in the expanded mode without the blades flipping or rotating forward to reconfigure the blades in a unbarbed mode. For example, the rearward movement of the connector body 150 stops when the end surface 156 engages or slaps against the face 137 that defines the bottom of the bore 136 in the stem portion 130.

Figure 14:
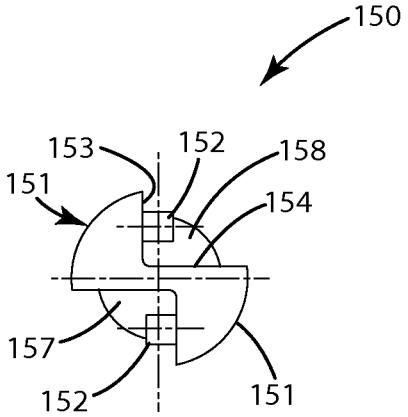
FIG. 14 is an end view of the alternative connector body for the two bladed version of the first alternative embodiment.
Figure 15:
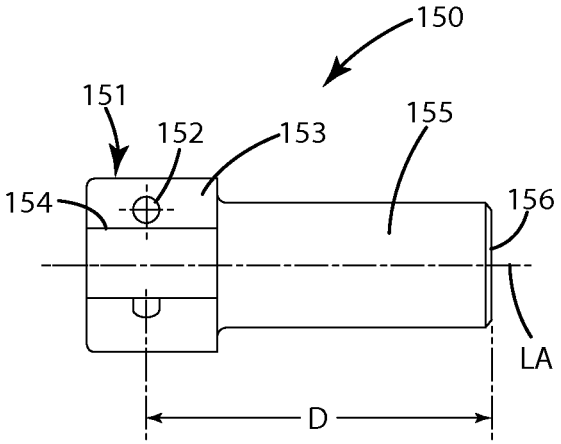
FIG. 15 is a side view of an alternative connector body for a three bladed version of the first alternative embodiment.
Figure 16:
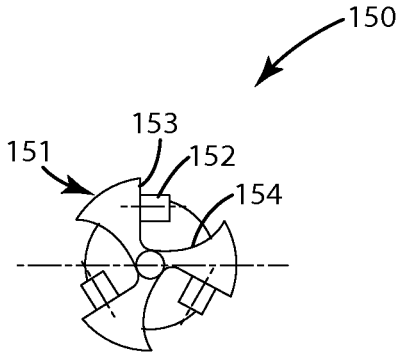
FIG. 16 is an end view of the alternative connector body for the three bladed version of the first alternative embodiment.
Figure 17:
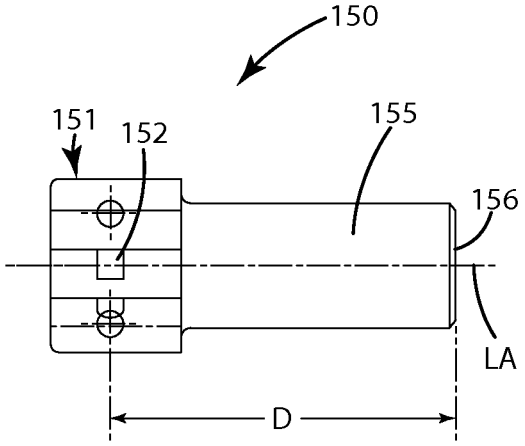
FIG. 17 is a side view of an alternative connector body for a four bladed version of the first alternative embodiment.
Figure 18:
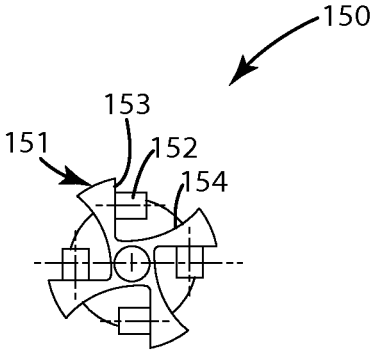
FIG. 18 is an end view of the alternative connector body for the four bladed version of the first alternative embodiment.

As shown in FIGS. 12-14, the connector body 150 generally can be a carriage element 151 which defines carriage recesses 157 and 158 which are sized and shaped to accommodate portions of the respective blades 140 therein, and enable those blades to pivot around the respective pins 152. As illustrated, the pins 152 can be in the form of projections, also referred to as bosses, that project from interior walls 153 of the carriage element 151, and that generally terminate at free ends. The bosses or pins can be shaped and sized to fit at least partially within the blade holes 144 defined by the blades, while still keeping the blades joined with the carriage element 151 in both the retracted and deployed modes. Opposite the interior boss walls, secondary interior walls 154 can be defined. These secondary interior walls can extend from a corner at which they intersect the respective interior boss walls to the exterior surface of the carriage element 151. These interior walls can be planar, or can be of either curved or angled configuration relative to a longitudinal axis LA of the carriage element and the broadhead 110.

While FIGS. 11-14 illustrate connector bodies and respective carriage components that accommodate two blades, these connector bodies can be easily modified to accommodate three, four or more blades using similar construction, for example, those shown in FIGS. 15-18.

To retain the blades 140 of the first alternative embodiment of the broadhead 110 in a retracted mode or closed in-flight position, elastomeric bands engaging the blades 140 can be used. Alternatively, a blade clip 160 as shown in FIG. 11 can be used. Such a clip can include a central opening 161 configured to fit over the generally cylindrical portion 134 of the stem 130. If wrench flats are provided on this portion 134 of the stem 130, corresponding flats may be provided in the opening 161 of the clip 160 to assist in orientation of the clip 160 to the blades 140. The clip can further include one or more tangs 162 that project forwardly of the base 166 of the clip. Optionally, when using such a clip, projections 145 can be provided on the rear portion of the web of the blades 140 to engage the clip 160.

Second Alternative Embodiment

A second alternative embodiment of the broadhead is illustrated in FIGS. 19-23 and generally designated 210. This embodiment is similar to the above embodiment in structure and operation with several exceptions. For example, the broadhead generally includes a ferrule body 230 that is joined with a penetrating tip 220, and that slidably houses a connector body 250. Optionally, the blades and the retainer element, such as a blade retention clip (not shown) used in this second alternative embodiment can be similar to those of the first alternative embodiment.

As described above, the ferrule 120 of the first alternative embodiment can be configured so the blades 140 and the connector body 150 can be slidably inserted in the ferrule 120. The ferrule 120 can be joined with a detachable stem portion 130 to facilitate assembly of this first alternative embodiment. As shown in FIGS. 19-22, however, the second alternative embodiment 210, includes a ferrule and stem that form an integral, single, one piece ferrule body 230. A detachable penetrating tip 220 is joined with this ferrule body 230.

To install the connector body 250 in the ferrule body 230, the tip 220 can be detached from the ferrule body 230 as illustrated in FIG. 19. With the tip 220 detached, the blades (not shown) and the connector body 250 can be inserted from the front of the ferrule. During assembly, with blades (not shown) pivotally mounted on the bosses 252 of the connector body 250, the rear cylindrical portion 255 of the connector body 250 initially engages the bore 236 of the ferrule body 230. As the connector body 250 slides rearward in the bore 236, the blades engage and/or move within or relative to slots 231 that extend from the surface of the bore 236 through the outer periphery 239 of the ferrule body 230. The fit between the bore 236 and the cylindrical surface 255 of the connector body 250 can define the axial or longitudinally alignment and movement of the blades. Slots 231 in the ferrule body 230 can restrict the lateral movement of the blades. With the blades and connector body 250 inserted in the ferrule body 230, the tip 220 can be re-attached and secured to the ferrule body 230, for example, by threading the mating internal threads 221 on the point 220 on the external threads on the ferrule body 230.

Figure 23:
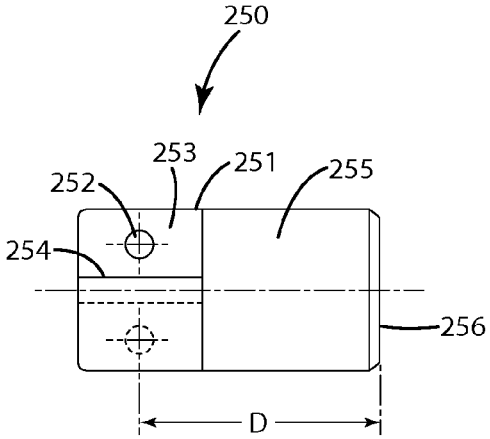
FIG. 23 is a side view of the connector body for a two bladed version of the second alternative embodiment of the broadhead.
Figure 24:
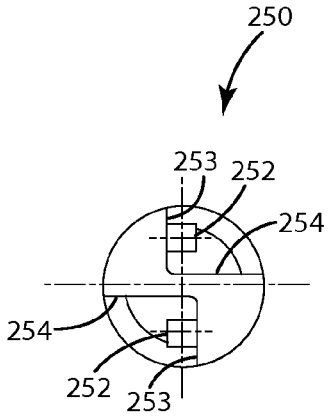
FIG. 24 is an end view of the connector body for the two bladed version of the second alternative embodiment of the broadhead.

For a two bladed version of the second alternative embodiment 210, as shown in FIGS. 19 and 23-24, the connector body, in the form of a carriage element 251 can define carriage recesses. For each blade, these recesses can include interior carriage walls 253 and 254, which can include bosses or pins similar to those of the embodiments described above. The cylindrical surface 255 on the rear portion of the carriage element 251, beyond the recesses, can be of the same diameter or larger than the forward portion thereof. While shown as cylindrical in shape, other geometric shapes may be employed to define the surface 255 including an interrupted or partial surface that may serve to reduce friction. Similarly, the bore 236 defined by ferrule body 230 may also be configured in a variety of shapes functionally compatible with the surface 255 of the connector body 250. Although not illustrated, the connector body 250 of the second alternative embodiment may be configured as three-blade and four-blade versions, similar to those shown for the first alternative embodiment in FIGS. 15-18.

The first and second alternative embodiments of the broadhead 110 and 210 can be similar in operation. In the second alternative embodiment 210 the upwardly curved portion 233 at the end of the slots 231, as shown in FIG. 20, can operate similar to the surface 133 on the stem portion 130 of the first alternative embodiment 110. For example, as the blades move rearward upon engagement with the target, the inner edge of the blades can engage with the upwardly curved portion 236 to force the blades outward until the end point in the rearward movement is reached, at which point the deployed mode of the broadhead is achieved. Optionally, notches may be provided on the inner edges of the blades to lock them in a fully open position.

As shown in FIG. 20, the rearward movement of the connector body 250 can stop when the end surface 256 encounters and engages the inner wall 237 of the stem. As shown in FIGS. 23 and 24, the connector body 250 can define a preselected distance D, to precisely define and to restrict the rearward travel of the blades, similar to the embodiments noted above. This can enable the blades to achieve the maximum opening without over-rotating to reconfigure the broadhead in an unbarbed mode. This feature, however, can be modified so the blades and broadhead can achieve an unbarbed mode if desired.

As with the first alternative embodiment 110, to retain the blades of the second alternative embodiment 210 in a closed in-flight position, elastomeric bands engaging the blades can be used. Optionally, a clip, similar to the clip 160 shown in FIG. 11, can be used. In this application, however, the clip 160 can be positioned at the front of the broadhead, adjacent the surface 240 of the ferrule body 230. Its central opening can be sized to fit over the outside diameter of the external thread 238 on the front of the ferrule body 230. The clip 160 can be trapped between the surface 240 and the mating surface 223 of the tip 220. The clip can be designed to engage a notch or boss on the blade web, or more generally, the forward portion of the blades, when the blades are in a retracted mode. The configuration of the notch or boss can be configured so that the clip releases the blades from the clip upon the engagement of one or more of the blades with a target.

Third Alternative Embodiment

Figure 25:
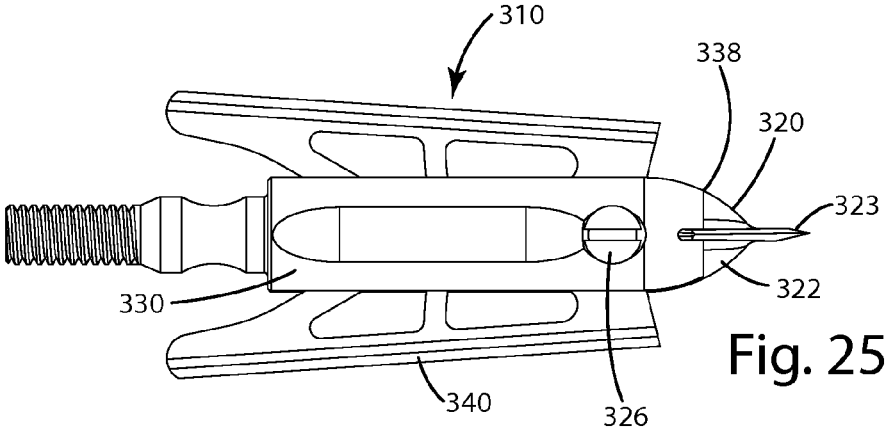
FIG. 25 is a side view of a third alternative embodiment of the broadhead in a retracted mode.
Figure 26:
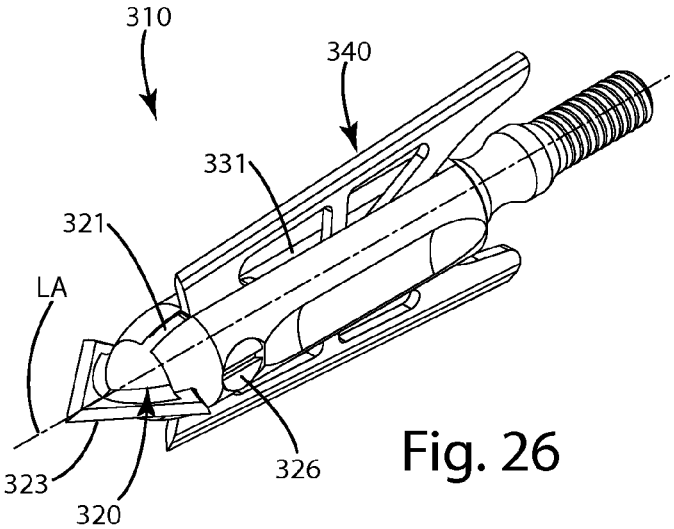
FIG. 26 is a side perspective view of the third alternative embodiment of the broadhead in a retracted mode.
Figure 27:
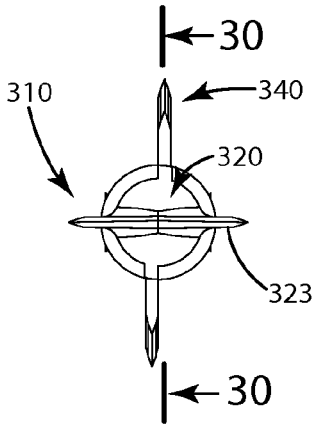
FIG. 27 is a front view of the third alternative embodiment of the broadhead in a retracted mode.

A third alternative embodiment of the broadhead is illustrated in FIGS. 25-44 and generally designated 310. This embodiment is similar to the above embodiments in structure and operation with several exceptions. For example, the broadhead generally includes a ferrule body 330 that is detachably joined with a penetrating tip 320 and that slidably houses a connector body 350. The connector body 350 can be joined with blades 340 which are adapted to deploy from a retracted mode shown in FIG. 25 to a deployed mode shown in FIG. 33.

The broadhead 310 generally includes a penetrating tip 320 which can be either a simple conical tip or trocar tip, or can be of a construction including sharpened blades as shown in FIGS. 33-37. In FIGS. 25-28, the tip 320 can include fins 321 that extend outward and rearward from a primary tip body 322. These fins can be configured and dimensioned to fit within the respective ferrule slots 331 defined by the ferrule 330. The fins can be further constructed so that they fit perfectly within those ferrule slots to prevent undesired movement of the tip 320 relative to the remainder of the ferrule 330. Although shown with only two fins 321, the tip 320 can be outfitted with only one fin or multiple fins. Further, if desired, the fins can be absent from the tip, and the tip 320 can be secured to the ferrule with a threaded construction joined with the front end of the ferrule 330.

Turning to FIGS. 25-31 and 33-39, the tip 320 can define integrally formed tip blades 323. These tip blades can project in a plane that is generally perpendicular to the plane in which the fins 321 are disposed. If desired, the plane in which the blades 323 are disposed can be at some other transverse angle relative to the plane in which the fins 321 are disposed, or if desired, the integral tip blades 323 can be extensions of the fins 321.

Figure 37:
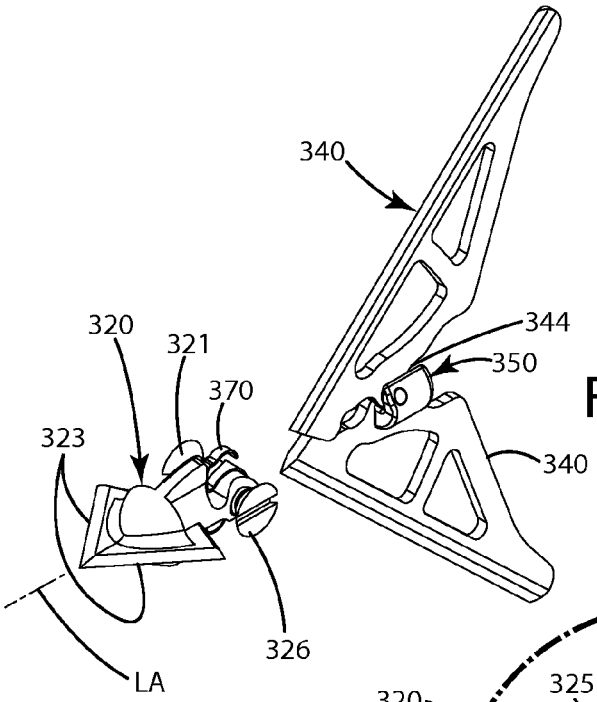
FIG. 37 is a front perspective view of the tip, carriage element and blades of the third alternative embodiment of the broadhead in the expanded mode.

As further shown in FIG. 37, the tip blades 323 can be generally perpendicular to the primary blades 340. Again, however, if desired, the tip ferrule 323 could be offset at a transverse angle and/or parallel to the primary blades 340. Optionally, although shown as being formed integrally with the tip 320, the tip blades 323 can be constructed as a separate component from the remainder of the tip. For example, the tip blades 323 can be a separate, sharpened unit that is simply joined within a slot defined by the tip 320. A fastener (not shown) can project through the tip to engage the tip blade unit and secure it to the remainder of the tip 320.

As shown, the tip 320 can be constructed from a metal injection molded process and can be from formed steel, titanium or other suitable metals. Alternatively, the tip 320 can be formed by machining or other molding operations, and can be constructed from aluminum or other lighter weight metals.

Figure 38:
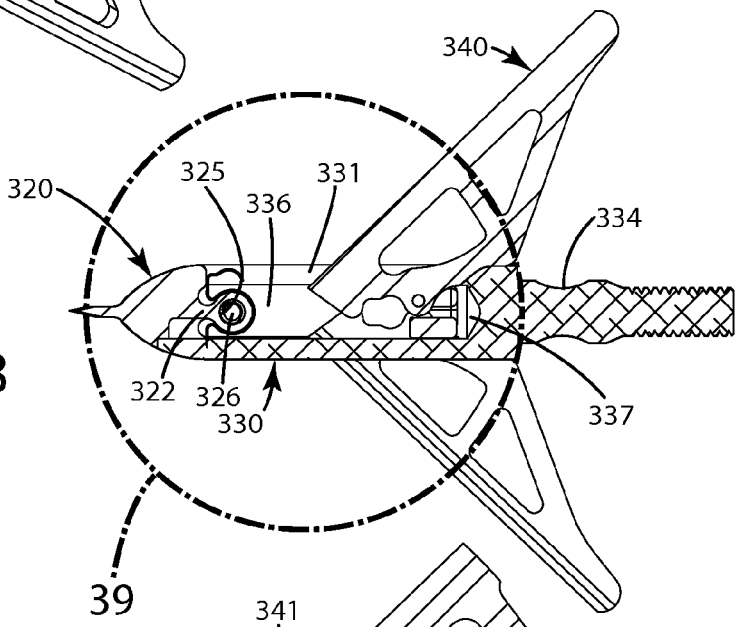
FIG. 38 is a partial sectional view of the broadhead of the third alternative embodiment in the expanded mode.
Figure 39:
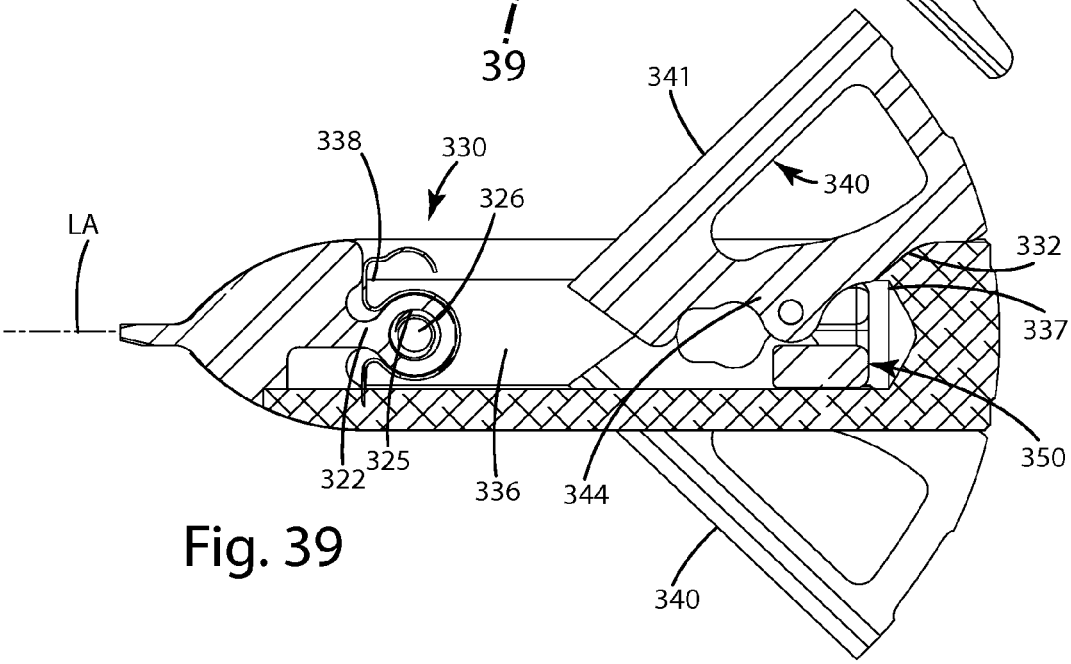
FIG. 39 is a partial close up view of the broadhead of the third alternative embodiment in the expanded mode.
Figure 40:
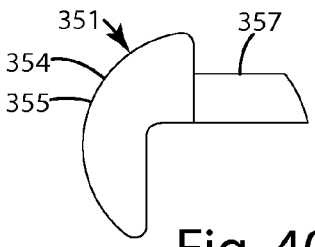
FIG. 40 is a front view of a first carriage element part of a connector body of the third alternative embodiment of the broadhead.
Figure 41:
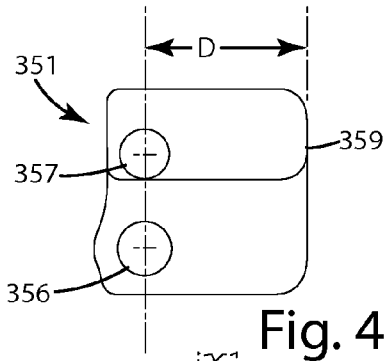
FIG. 41 is a side view of the first carriage element part of the connector body of the third alternative embodiment of the broadhead.
Figure 42:
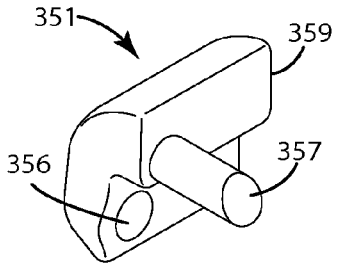
FIG. 42 is a front perspective view of the first carriage element part of the connector body of the third alternative embodiment of the broadhead.
Figure 43:
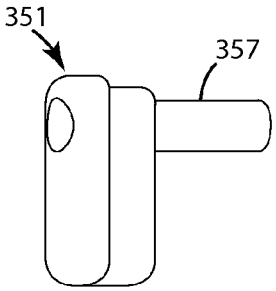
FIG. 43 is a top view of the first carriage element part of the connector body of the third alternative embodiment of the broadhead.

As illustrated in FIGS. 37-39, the tip 320 can include or be joined with a connector portion 322 that is adapted to connect the tip 320 to the ferrule 330. For example, this tip connector portion or base 322 can define a tip hole 325. The hole 325 can be configured, sized and optionally threaded to receive one or more fasteners 326. These fasteners 326 can project through corresponding holes defined in the ferrule body 330 and into respective threaded holes 325 to secure the tip 320 to the ferrule 330. Of course, the fasteners and/or hole need not necessarily be threaded. For example, a rolled pin can be projected through the hole 325 of the connector portion to secure the tip 320 to the ferrule 330.

As illustrated, the hole 325 defined in the connector portion 322 can be transverse, and more particularly, perpendicular to the plane in which the blades move. Further, the hole and fasteners can be transverse, and more particularly perpendicular, to the plane in which the blades move. In another sense, the hole and fastener can be aligned in a plane that is substantially parallel to the plane in which the tip blades 323 lie. This optionally can provide enhanced stability and prevent side-to-side wobble of the tip blades.

Figure 31:
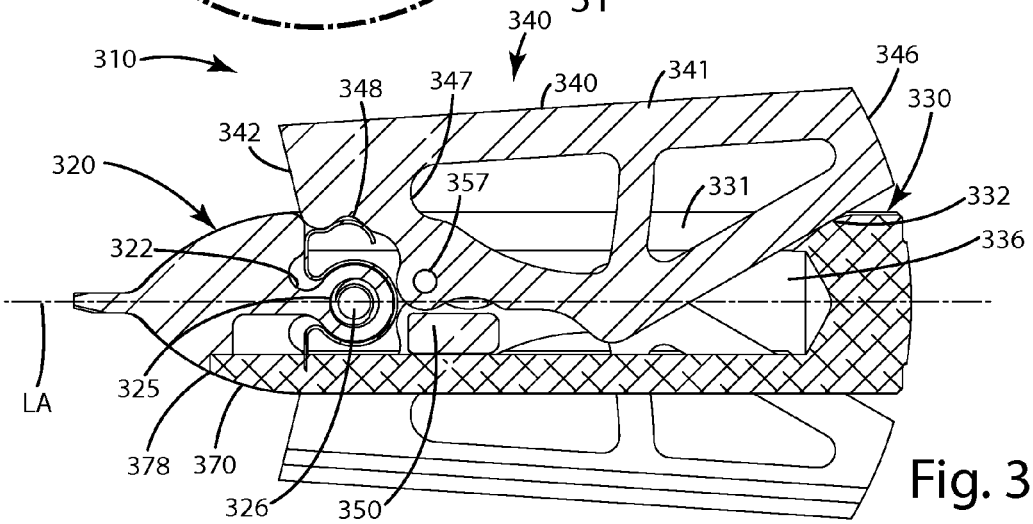
FIG. 31 is a close-up of the sectional view in a retracted mode of the third alternative embodiment of the broadhead in FIG. 30.

As shown in FIGS. 31, 38 and 39, the ferrule 330 generally defines an interior compartment or bore 336. This bore includes a bottom 337 opposite a forward opening 338 within which the tip 320 is seated. The bottom can be flat or of other geometric configurations depending on the desired application. The bore 336 as illustrated is substantially cylindrical, however, it can be of a variety of constructions and geometric cross sections. For example, it can have a cross section that is elliptical, triangular, square, rectangular, polygonal or some other shape. Generally, it can be shaped to receive the blade connector body 350, which in this embodiment is formed as a carriage element.

The ferrule 330 can also define one, two, three, four or more ferrule slots 331 that extend radially outwardly in the longitudinal axis LA of the broadhead 310. The slots 331 can be sized to perfectly receive the blades 340 and can have tolerances between the boundaries of the ferrule slots 331 and blades 340 to enable the blades to slide rearwardly from a retracted mode, as shown in FIGS. 25-32, to a deployed or expanded mode, as shown in FIGS. 33-39, in a desired manner.

Optionally, the ferrule 330 can be integrally formed with a stem 334. Put another way, the ferrule 330 and stem 334 can be a single, one-piece monolithic unit. The stem can define conventional threads to enable it to be secured to an insert and joined with an arrow. The ferrule and stem can be machined, formed or molded from metal or other materials similar to the embodiments described above.

Figure 32:
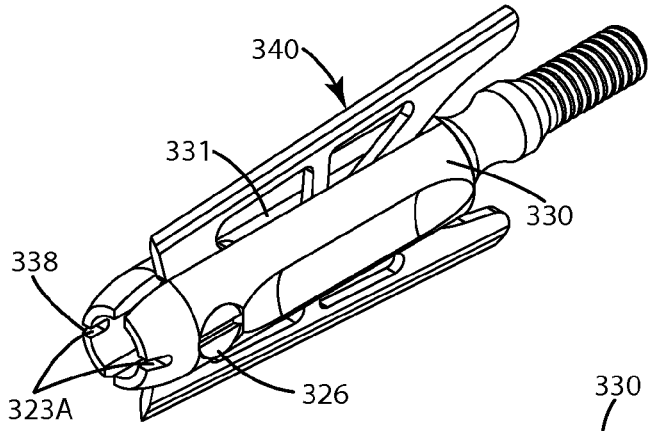
FIG. 32 is a front perspective view of the broadhead of the third alternative embodiment with a tip removed.
Figure 34:
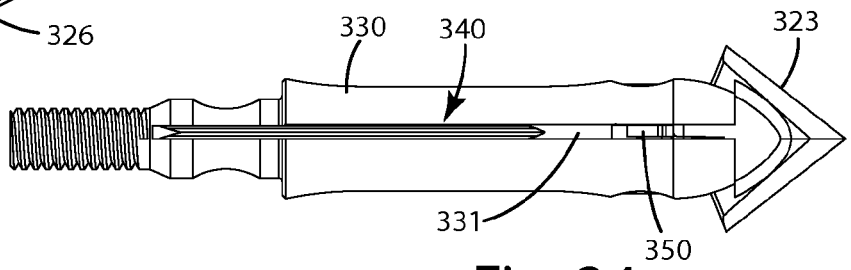
FIG. 34 is a side view of the third alternative embodiment of the broadhead in an expanded mode.
Figure 33:
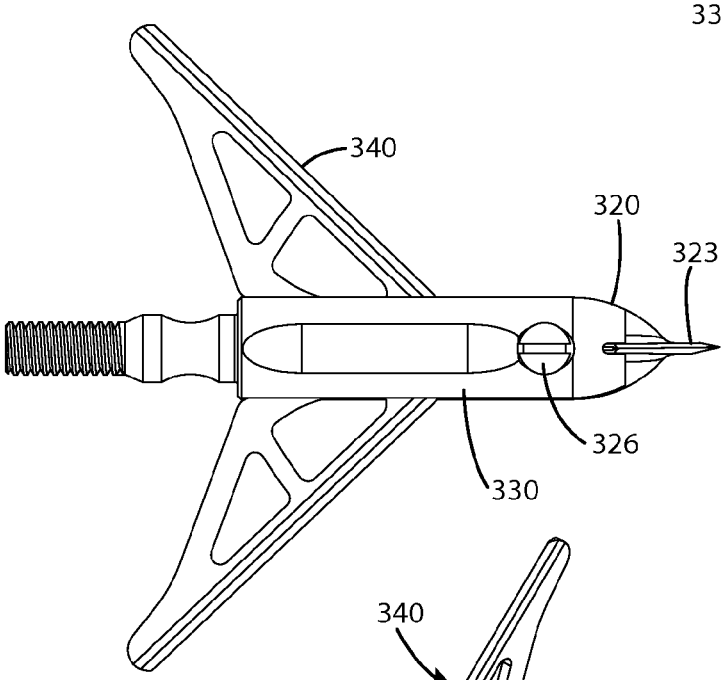
FIG. 33 is a side view of the broadhead of the third alternative embodiment in an expanded mode.
Figure 35:
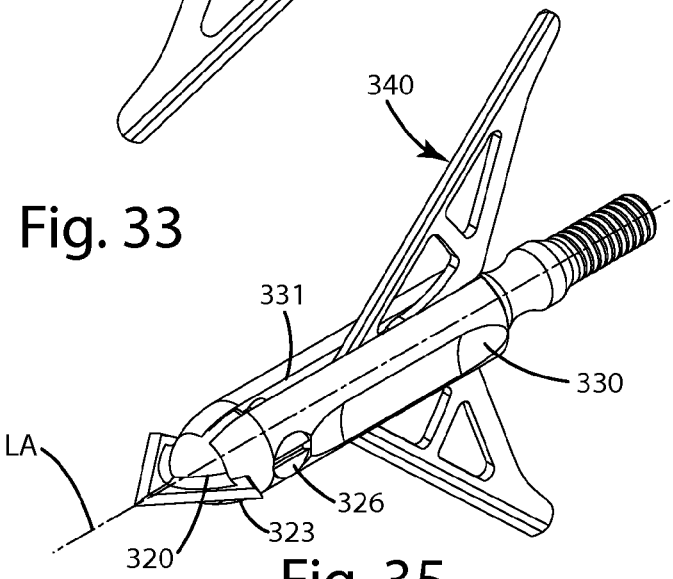
FIG. 35 is a front perspective view of the broadhead of the third alternative embodiment in the expanded mode.
Figure 36:
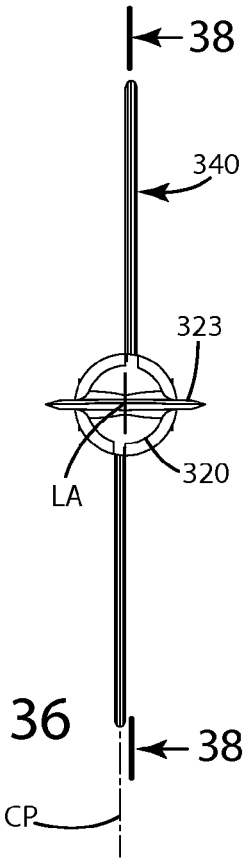
FIG. 36 is a front view of the broadhead of the third alternative embodiment in the expanded mode.

As shown in FIG. 32, the ferrule 330 also can define ferrule tip slots 323A within which the tip blades 323 register when the tip 320 is installed on the ferrule 330. These blade tip slots 323A can be of a preselected dimension and angular orientation relative to the longitudinal axis LA. As illustrated, the blade tip slots 323A are generally at a 90° angle or generally perpendicular to the blade slots 331. Of course, where more tip blades are included in the tip, the slots can be offset from one another at a variety of angles. Alternatively, the tip 320 can be configured to include multiple tip blades, and those tip blades can be inserted in respective ones of the blade slots 331 and the blade tip slots 323A.

In operation, the tip 320, fasteners 326 and respective retainer element 370 can be removed from the ferrule by removing the tip fasteners 326, optionally with a tool, from the blade and respective connector portion 322. The tip 320 can then be slid forwardly, out from the bore 336, as well as the forward opening 338 of the ferrule 330. With the tip removed, the blades 340 and carriage element 351 can be removed and the blades can be replaced, cleaned or otherwise serviced by the user.

The broadhead 310 can include a retainer element 370 of varying forms. As shown in FIGS. 28-31, 38 and 46, the retainer element is in the form of a retention spring. This retainer element 370 can include a spring connector portion 374 that is adapted to join with the connector portion 322 of the tip 320. The spring connector portion 374 can be of a partially circular construction so that it wraps and clips around the connector portion 322 of the tip 320. Likewise, the spring connector portion 322 can surround at least a portion of the holes 325 and respective tip fasteners 326 when installed in the ferrule 330.

Figure 29:
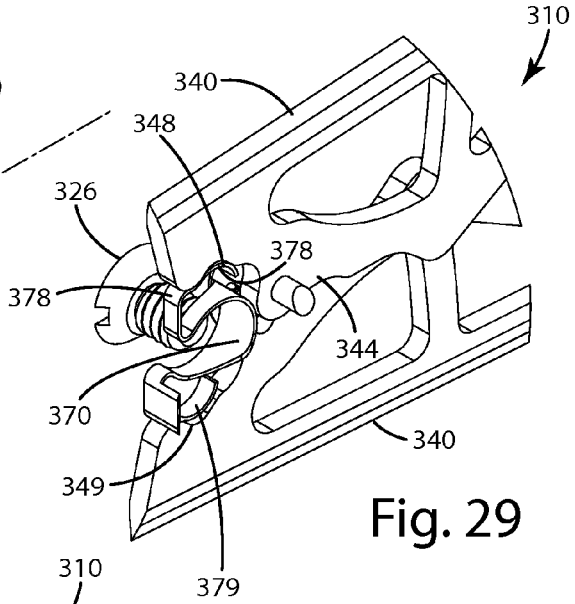
FIG. 29 is a close-up view of a retainer element and blades of the third alternative embodiment of the broadhead.
Figure 30:
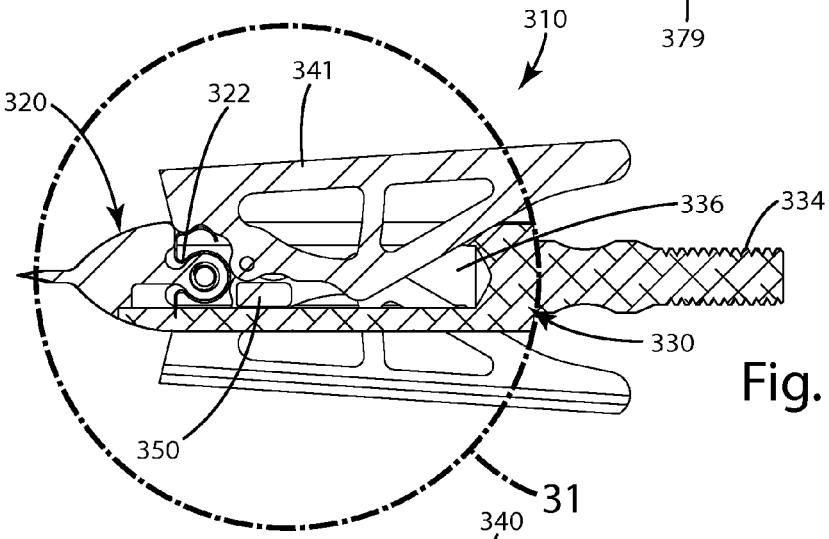
FIG. 30 is a sectional view of the third alternative embodiment of the broadhead taken along line 30-30 of FIG. 27.
Figure 46:
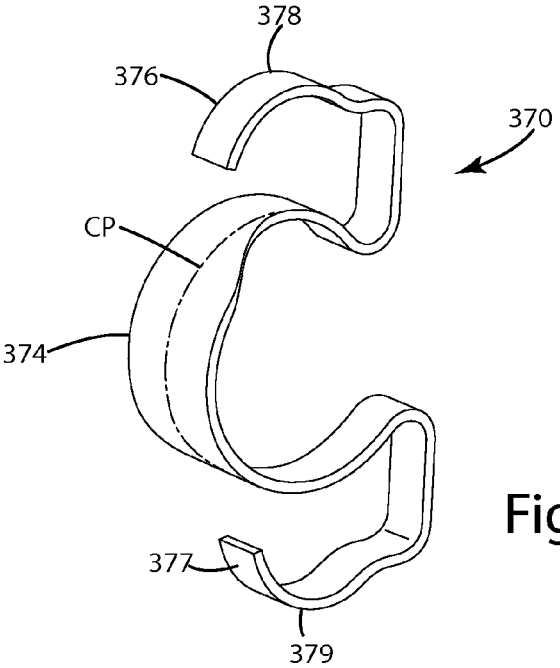
FIG. 46 is a perspective view of a retainer element used in connection with the third alternative embodiment of the broadhead.

The retainer element 370 can include opposing tangs 376 and 377. These tangs 376 and 377 can be offset on opposite sides of a central plane CP, as shown in FIG. 46, so that they can accommodate the offset nature of the blades 340 themselves. For example, the blades 340 can be situated side-by-side one another so that an inside blade surface of one blade generally can engage the inside blade surface of the opposing blade when the blades move relative to one another in the ferrule 330. The tangs 376 and 377 also can include blade engagement portions 378 and 379 that are generally curved or angled projections. These engagement portions 378 and 379 can engage respective retainer element recesses 348 and 349 defined by the forward portions of the blades 340. As shown in FIGS. 29-31, the retainer element 370 can engage and can be joined with the ferrule 330 near the opening 338 of the ferrule opposite the stem 334. More particularly, the retainer element 370 can be joined directly with the blade tip 320 and is in contact with that tip 320. The retainer element 370 also can engage the forwardmost portions of the blades 340, generally forward of their respective pivot points, both when the blade is in the retracted mode shown in FIG. 31 and the deployed mode shown in FIG. 39.

Optionally, the retainer element can engage the inner edges or surfaces of the blades, and can be substantially concealed from view from the exterior of the broadhead 310. Indeed, as shown, the retainer element 370 can be positioned substantially within the exterior surfaces of the ferrule 330, without being located on the exterior of the ferrule. This can provide enhanced longevity of the retainer element and reduce its destruction upon engagement with a target because it is substantially housed in the interior of the ferrule 330. For example, it is disposed at least within the internal bore 336, and optionally within the respective ferrule slots 331. In that regard, at least a portion of the retainer element 370 can be located within a ferrule slot, optionally at the forwardmost end of the ferrule slots adjacent the tip.

Each blade 340 can include an outer cutting edges 341 that extend to a forward edge 342. This forward edge 342 can transition to an inner edge, and more particularly, to retainer recesses 348 and 349. The blades also can define respective pivot pin holes 347 that accept pins 352 of the respective carriage body 350. The inner edges of the blades 340 also can be configured to extend from the retainer recesses 348 to camming surfaces 346 that cam against respective blade camming surfaces 332 defined by the ferrule 330.

Figure 28:
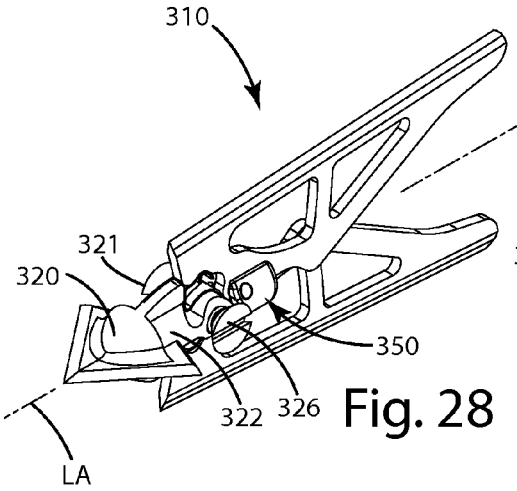
FIG. 28 is another side perspective view of a tip, blades and carriage element of the third alternative embodiment of the broadhead in a retracted mode.
Figure 44:
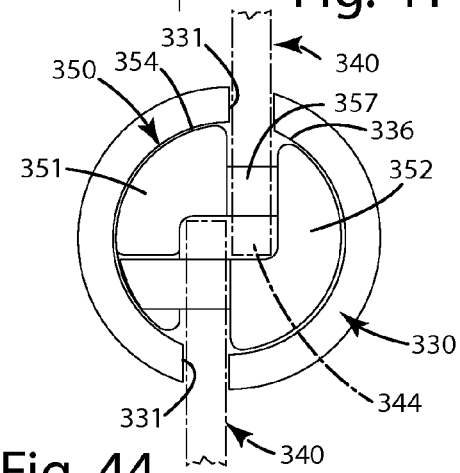
FIG. 44 is a top view of the first carriage element part joined with a second carriage element part to form the connector body located within a bore of a ferrule of the third alternative embodiment of the broadhead.

As illustrated in FIGS. 28, 30, 31, 37 and 40-44, the connector element 350 can be configured to be slidably and movedly disposed within the internal bore 336 of the ferrule 330. The connector element 350 as illustrated in FIGS. 28 and 44 generally includes two opposing carriage element parts that form the carriage element, namely, the first carriage element part 351 and a second carriage element part 352. These element parts can be substantially identical to one another in the illustrated configuration. These element parts can each include an exterior surface 354 which, when the elements are combined, forms a partially cylindrical configuration as shown in FIG. 44. This partially cylindrical form can correspond to the internal bore 336 which also can be cylindrical. Of course, where other geometric shapes are desired, the exterior surfaces 354 of the respective carriage element parts can vary to reflect those different shapes. Moreover, if desired, the exterior surface 354 can include recesses (not shown) to reduce weight or otherwise change the outer configuration of the exterior surface 354. If desired, the interior surface of the bore 336 can be modified to include ridges or raised portions or other guiding elements that interfit within the recesses 355 to further control movement of the carriage element in the bore 336.

Each of the carriage element parts can define a pin bore 356 and can include a pin or boss 357. The pins 357 and hole 356 of the respective first and second carriage element parts 351 and 352 can fit within and/or accept the respective pins and holes of the other carriage element, and can interlock the elements together as shown in FIG. 44. If desired, the free end of the pins 357 can include a curved surface or angled surface to match the exterior surface 354 of the opposing carriage element part.

As further shown in FIG. 44, the blades can effectively be sandwiched between the respective first and second carriage element parts 351 and 352. For example, the blade connector portions 344, which define the respective pin holes in the blades, can be located between the first and second carriage element parts 351 and 352. These blade connector portions 344 can lay immediately adjacent one another and also between the respective carriage element parts 351 and 352. Generally, the pivoting portions 344 of the blades can be of a geometry that enables the blades to pivot about the respective pins 357 (FIGS. 40-45) without engaging the inner contours of the respective elements which might interrupt the rotation of the blades. If desired, a stop can be incorporated into the carriage elements to engage the connector portions 349 or other parts of the inner edge of the blades, thereby limiting the amount of pivoting of the respective blades, and optionally acting as a stop to control the extent of expansion of the blades when in a deployed mode.

Figure 45:
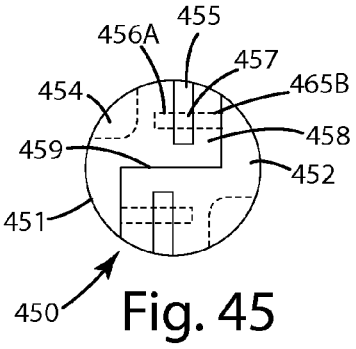
FIG. 45 is an alternative connector body of the third alternative embodiment of the broadhead.

Optionally, one of the carriage element parts can define two pins and the opposing carriage element can define two holes, and the respective pieces can be fitted together with the blades appropriately attached and pivotally connected to the pins. Other configurations are contemplated. For example, as shown in FIG. 45, an alternative connector body in the form of carriage element 450 can include respective first and second carriage element parts 451 and 452 that each define carriage voids 455 within which the blades can be located. The carriage voids slots can be bounded by an outer carriage wall 458 so that the carriage voids are not effectively closed by the joining of the first and second carriage element parts 451 and 452. Likewise, the carriage element parts 451 and 452 can be mated together at a parting line or surface 459 where the respective surfaces of both of the carriage element parts 451 and 452 are placed immediately adjacent one another. In this manner, the entire central portion about the axis of the carriage element 450 is closed. With this construction, the mating of the carriage element parts can also be precisely controlled due to careful construction and surface configuration of the joining surfaces 459.

Returning to carriage element construction shown in FIGS. 37 and 40-44, the first and second carriage element parts 351 and 352 can be joined with one another and a blade simply by installing a blade 340 on the carriage element pins, joining the respective carriage element parts 351 and 352, and inserting and sliding the assembled carriage element in the internal bore 336 of the ferrule 330. Because the carriage element parts 351 and 352 are restricted from moving apart from one another by being constrained within the internal bore, they cannot be substantially separated from one another within the bore, and effectively lock the blades 340 in the respective ferrule slots 331 so that the blades 340 are constrained to move within the ferrule slots 331.

The connector body 350 in the form of a carriage element also can be configured to be of a length D (FIG. 41) that extends from the center lines of the pins 357 to the end surface 359 of the carriage element 350. This length D can be preselected so that the carriage element is configured to impact the bottom 337 of the bore 336 in the ferrule (FIG. 39) and stop rearward movement of the blades when the blades are converted from a retracted mode to a deployed mode. Optionally, as shown in FIG. 39, the camming surfaces 332 of the ferrule can be configured to engage certain portions of the inner edge of the blade 340 to stop the rearward carriage motion, and prevent the blades from flipping forward relative to the ferrule to an unbarbed configuration. Further optionally, as with other embodiments herein, the broadhead components can be configured so that the blades will convert from a deployed mode to an unbarbed mode as desired.

Operation of the broadhead shown in FIGS. 30-31 and 38-39 will now be described. As shown in FIGS. 30-31, the blades are in a retracted position or mode. The blade retainer element 370 engages the blade retainer recesses 348 and 349, and in particular, the tangs 378 and 379 engage those recesses 348 and 349 with sufficient force to create a moment about the respective pins 357 so that the rearward portion of inner edges of the blades 340 forcibly engage the camming surfaces 332 so that the blades will not rotate about the pins 357. Accordingly, the blades 340 remain in the retracted position shown in FIGS. 30 and 31.

When the broadhead 310 is connected to an arrow (not shown) and the arrow is shot from a bow, the tip 320 first penetrates the target. The forward edges 342 of the blades engage the target. Upon sufficient penetration, the blades 340 are urged rearward by the force of the arrow engaging the target. Accordingly, the force involved in this action overcomes the forces exerted by the tangs 378, 379 on the respective retainer recesses 348, 349. In turn, the blades 340 start to move together in unison as a unit with the carriage element 350. The carriage element 350 generally slides longitudinally, parallel to the axis LA within the internal bore 336 of the ferrule. The blades 340 cam outwardly and expand with further rearward movement so that the cutting diameter of the broadhead 310 increases. The interaction of inner edges of the blades 340 and the camming surfaces 332 assist to promote this camming action as explained in the embodiments above. The rearward motion of the blades in the carriage element 350 is ultimately stopped by virtue of the inner edge of the blades 340 sufficiently engaging the camming surfaces 332 at the rearwardmost deployed positioning of the blades and/or the carriage 350 engaging the bottom 337 of the bore 336.

Fourth Alternative Embodiment

Figure 47:
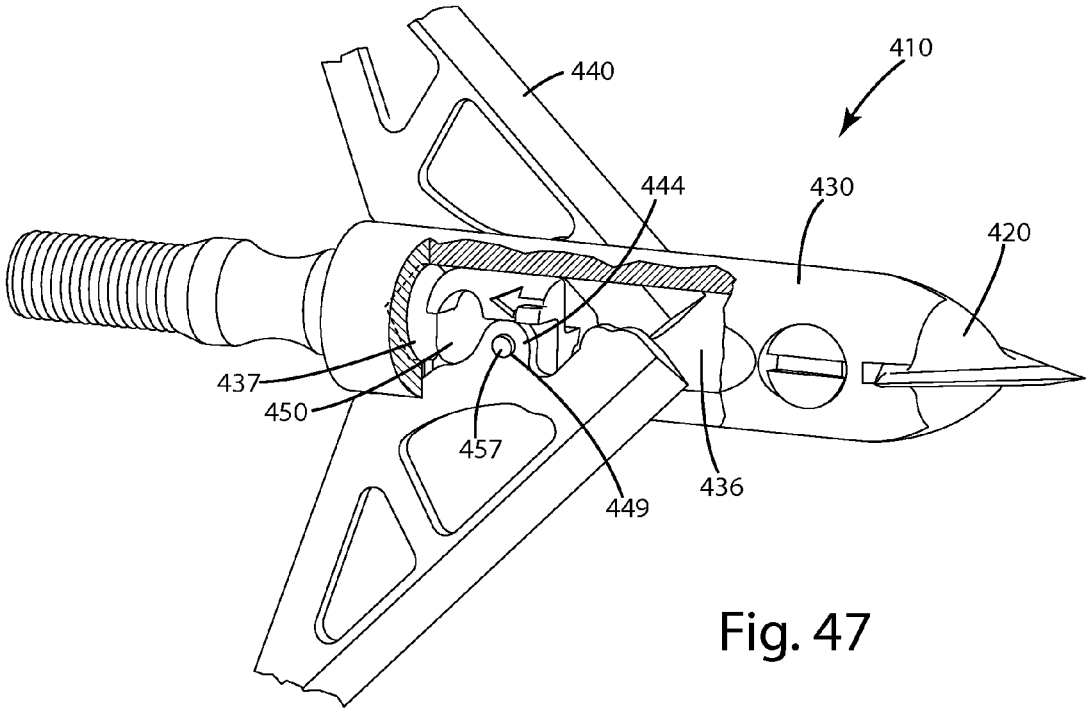
FIG. 47 is a perspective view of a fourth alternative embodiment of the broadhead in an expanded mode.
Figure 48:
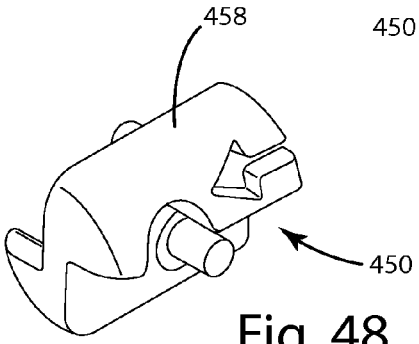
FIG. 48 is a perspective view of a connector body of the fourth alternative embodiment of the broadhead.
Figure 49:
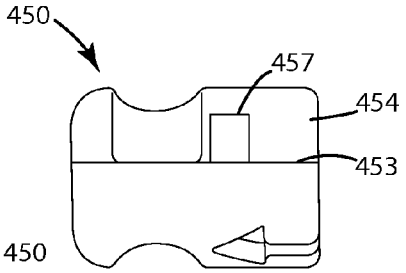
FIG. 49 is a top view of the connector body of the fourth alternative embodiment of the broadhead.

A fourth alternative embodiment of the broadhead is illustrated in FIGS. 47-52 and generally designated 410. This embodiment is similar to the above embodiments in structure and operation with several exceptions. For example, the broadhead generally includes a ferrule body 430 that is joined with a detachable penetrating tip 420. The ferrule 430 defines an internal bore 436 within which a connector body in the form of a carriage element 450 is slidably positioned. The carriage element 450 is joined with respective blades 440, which are adapted to deploy from a retracted mode to a deployed mode, as shown in FIG. 47.

The carriage element of this embodiment, however, can differ from that of the above embodiments. For example, as shown in FIGS. 48-52, the carriage element 450 can be a substantially monolithic, one-piece, unitary structure including an elongated body. Of course, if a multi-component structure is desired, that can be substituted for the carriage element 450 as shown.

The carriage element 450 can include an outer surface or periphery 458 which can form the outermost boundaries of the elongated body. As illustrated, the exterior surface 458 can be at least partially rounded to engage the internal bore 436 of the ferrule 430, which likewise can be rounded and optionally of a cylindrical form. Of course, if other cross sections of the respective bore 436 and exterior surface 458 are desired, those can be readily substituted.

Figure 52:
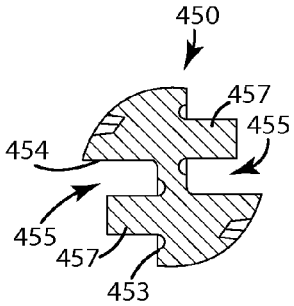
FIG. 52 is a section view of the connector body of the broadhead taken along lines 52-52 of FIG. 50.
Figure 50:
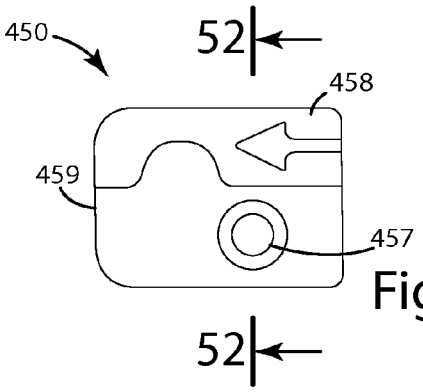
FIG. 50 is a side view of the connector body of the fourth alternative embodiment of the broadhead.
Figure 51:
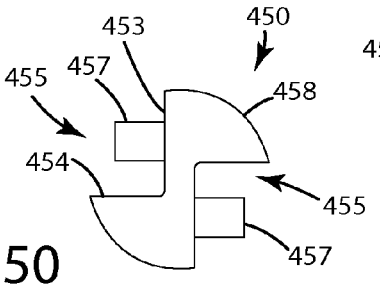
FIG. 51 is an end view of the connector body of the fourth alternative embodiment of the broadhead.

The carriage element 450 exterior surface 458 can define one or more carriage recesses 455 (FIGS. 51, 52). These recesses can be shaped generally to accommodate the pivoting motion of the connector portion 444 of the respective blades 440. The carriage recesses 455 also can be configured to include a first carriage wall 453 and a second carriage wall 454 which are generally transverse, and optionally perpendicular to one another, meeting at an internal corner. To the first carriage wall 453, a projection, such as a pin or boss 457, can project outwardly, away from that wall. This projection 457 can extend generally parallel to the second interior wall 454. The projection 457 also can fit within the respective holes 449 defined by the respective blades 440, as described in the embodiments above, so that the blades 440 can pivot about the projection 457 as also described above.

Although shown as being substantially planar, the respective carriage recess walls 453 and 454 can be curved or angled depending on the desired application. Generally, the first carriage wall 453 can be planar so that the blade can move adjacent it. Of course, if desired, these respective surfaces 453 and 454 can be convex or concave or of other configurations depending on the desired performance attributes of the carriage element. The number of projections and recesses can also vary to accommodate different number of blades.

In operation, the broadhead 410 and its respective components can deploy from a retracted mode to the deployed mode as shown in FIG. 47 similar to the embodiments noted above.

Fifth Alternative Embodiment

A fifth alternative embodiment of the broadhead is illustrated in FIGS. 53-61 and generally designated 510. This embodiment is similar to the above embodiments in structure and operation with several exceptions. For example, the broadhead generally includes a ferrule 530 that defines a bore 536. Blades 540 are joined with a connector body 550, which is shown in the form of a carriage element including an elongated body. The carriage element 550 is slidably disposed within the bore 536 defined by the ferrule.

Figure 54:
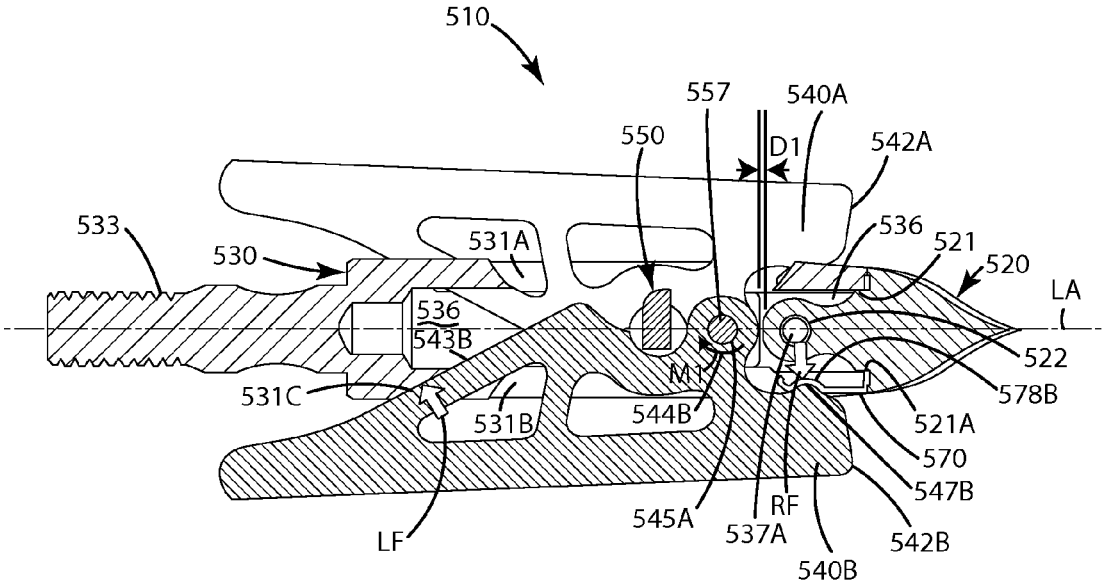
FIG. 54 is a section view of the fifth alternative embodiment of the broadhead with blades in a retracted mode.

The carriage element 550 and blades 540 are configured to move as a blade connector assembly, generally away from the penetrating tip 520. As an example, the broadhead can be configured in a retracted mode as shown in FIG. 54, but upon engaging a target, can be transformed so that the blades 540 and blade connector assembly including the blades 540 and the connector body 550 move rearwardly to the deployed mode shown in FIG. 55. There, the blades 540 are fully deployed or expanded and configured to cut and otherwise engage a penetrated target. Generally the blades 540 move rearward from the penetrating tip 520 in unison with one another, and generally in unison with the carriage element 550 (because they are attached to the carriage element) from the retracted mode to the deployed mode.

Figure 56:
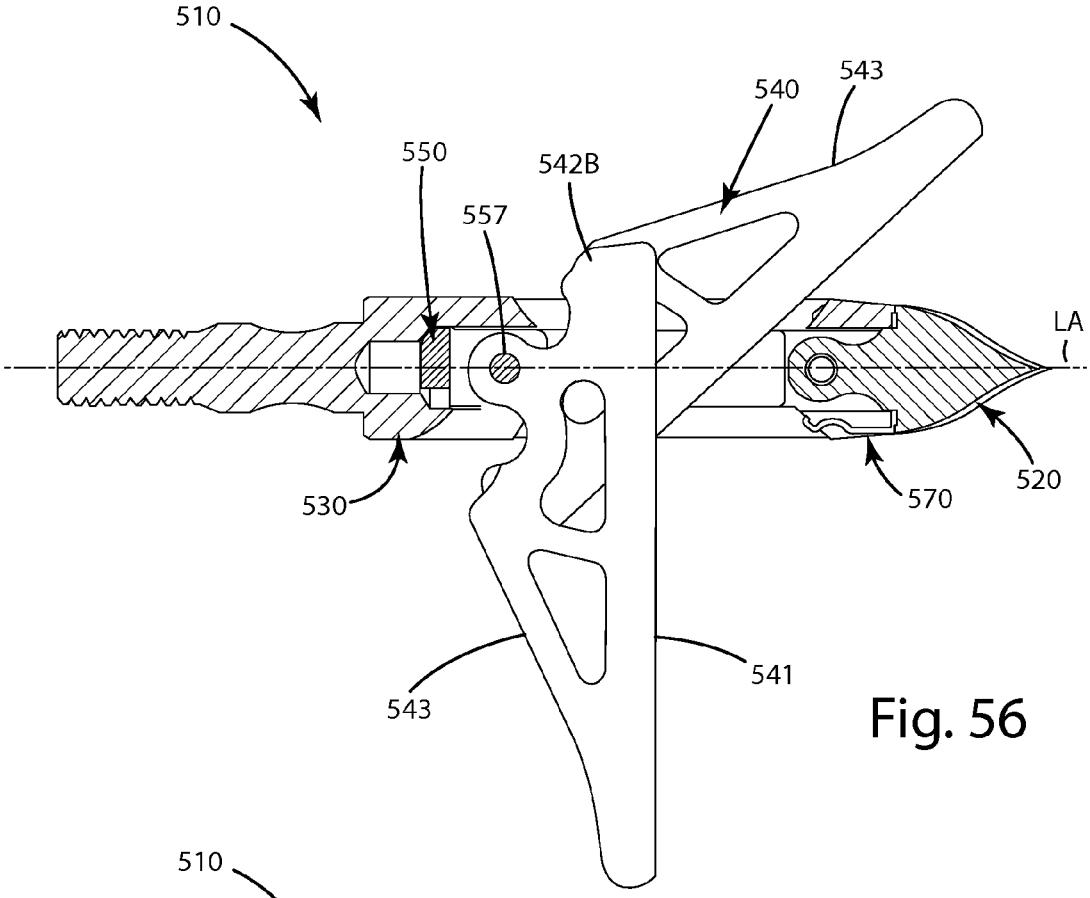
FIG. 56 is a section view of the fifth alternative embodiment of the broadhead with blades in a partially unbarbed mode.
Figure 57:
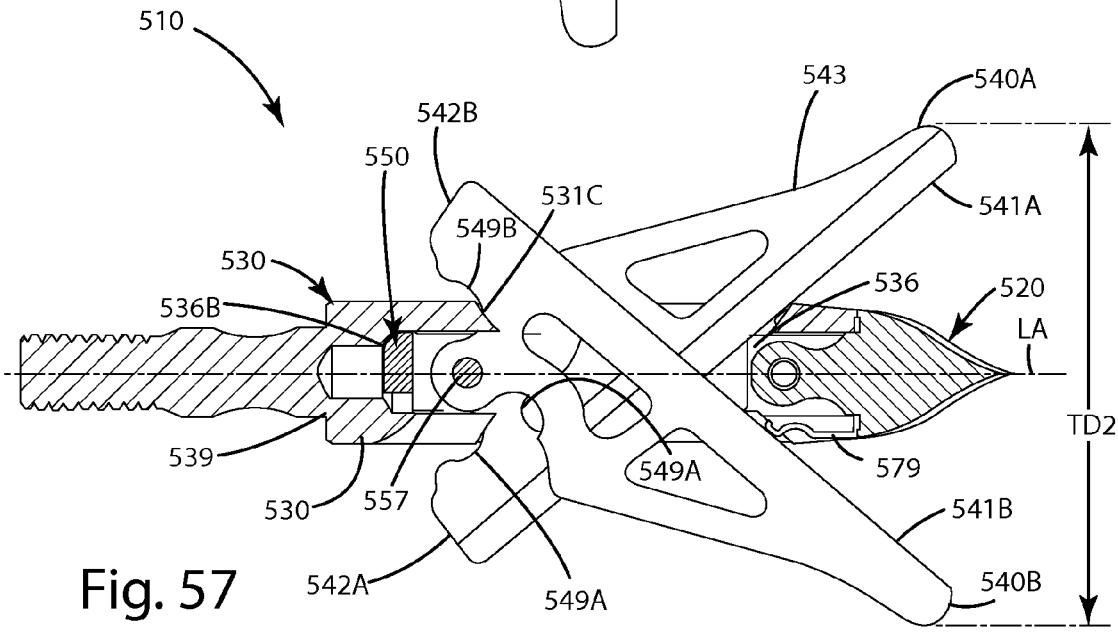
FIG. 57 is a section view of the broadhead of the fifth alternative embodiment blades in a fully unbarbed mode.

The fifth embodiment of the broadhead also can be configured so that the blades 540 can pivot about the connector body, for example, a portion of the carriage element 550, from the deployed mode to an unbarbed mode. For example, as shown in FIGS. 56 and 57, the blades 540 can pivot about the carriage element 550, and in particular, the carriage pin 557, so that the blades effectively swivel and translate so that the outer cutting edges 541 generally face toward the longitudinal axis LA of the broadhead, while the inner edges 543 face outward, away from the longitudinal axis LA in the unbarbed mode of the broadhead 510.

Figure 53:
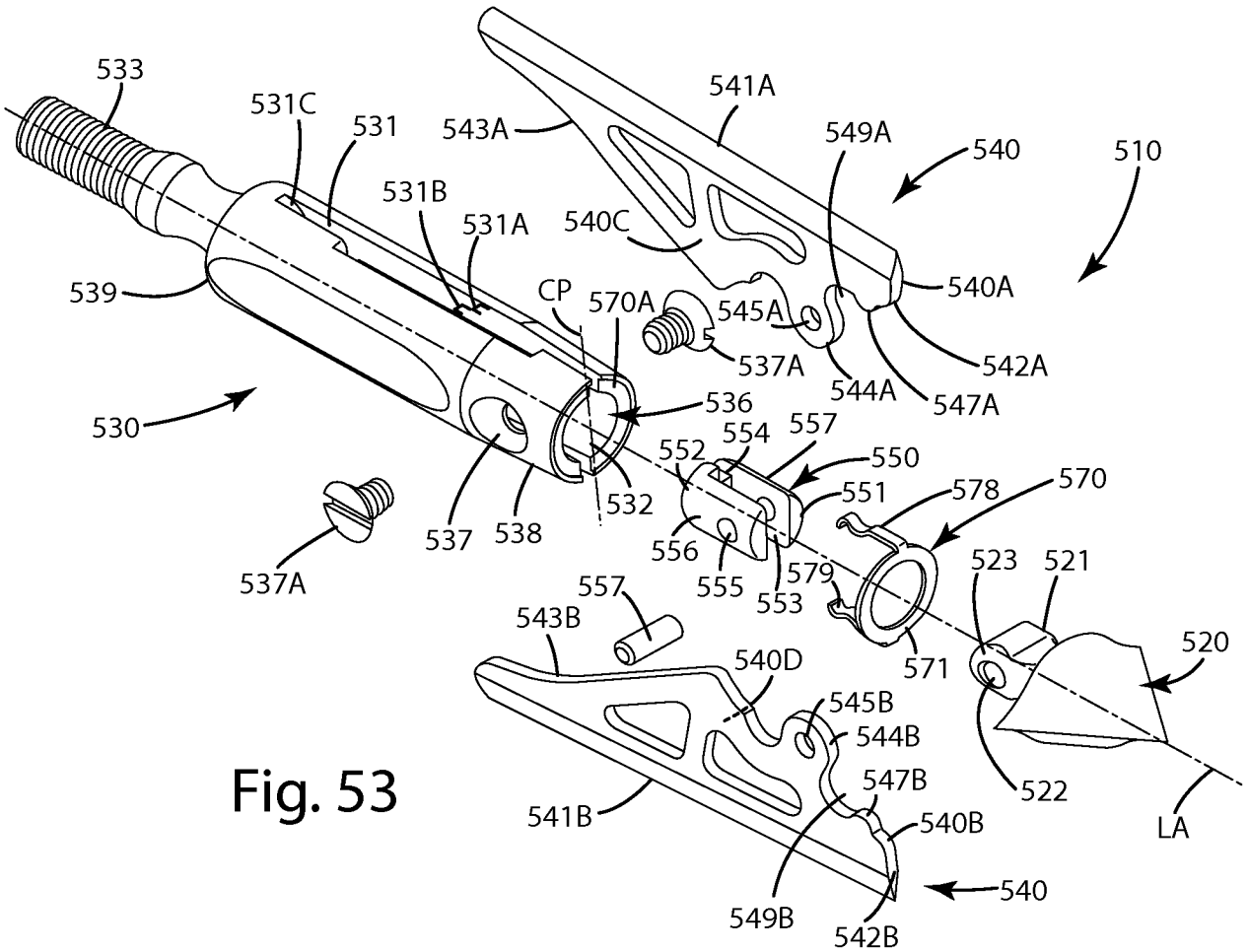
FIG. 53 is perspective exploded view of a fifth alternative embodiment of the broadhead.

The construction and operation of the fifth alternative embodiment of the broadhead will be now be described in more detail. As shown in FIG. 53, the ferrule 530 can include a first end 539 which joins with the stem 533. The stem can be integral or detachable from the ferrule 530. The opposing second end or forward end 538 of the ferrule 530 can open to the bore 536 defined by the ferrule 530. The ferrule can also define ferrule slots 531, which extend from an inner wall 532 that generally surrounds the bore 536 and forms its periphery, to an exterior of the ferrule 530. The inner wall 532 can be interrupted by the ferrule slots 531. The inner wall 532 and the bore 532 as shown can be of a generally cylindrical shape, however, they may be of other geometric shapes, such as oval, square, triangular, rectangular, polygonal or other shape.

Figure 55:
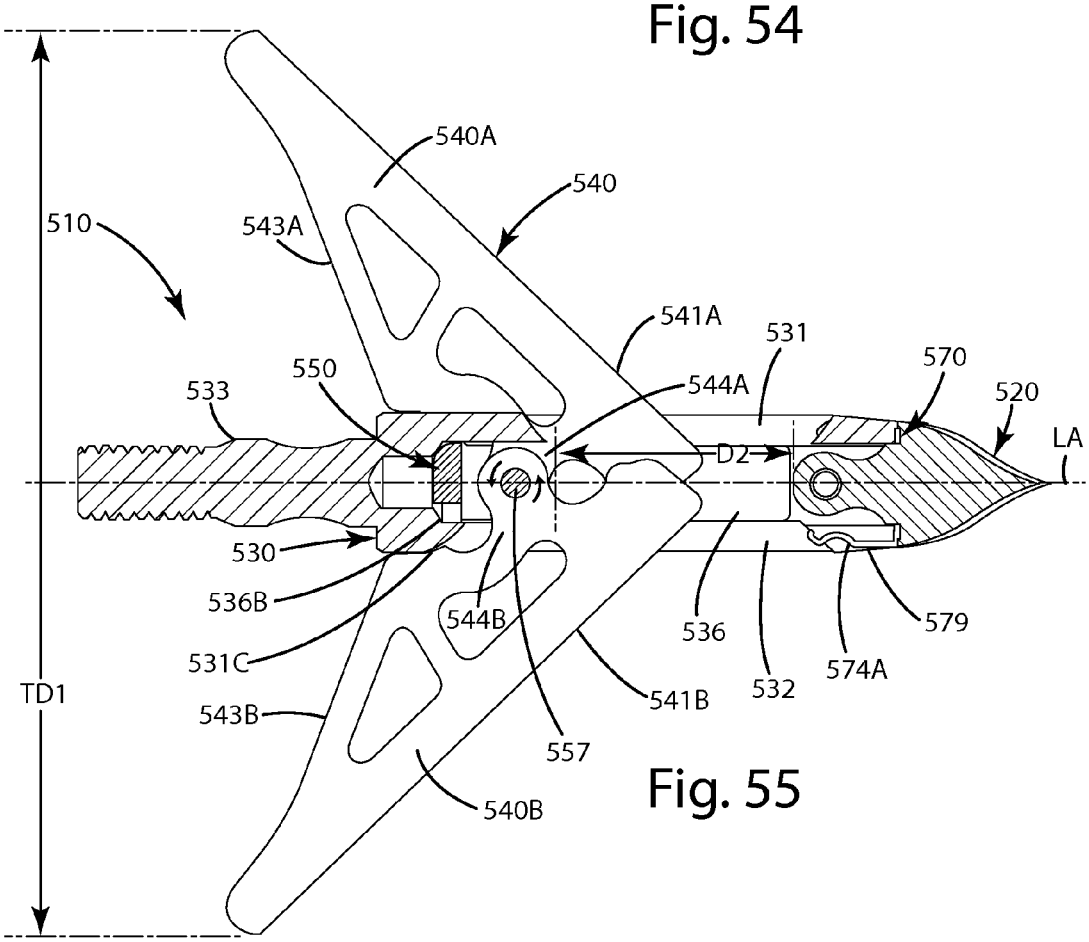
FIG. 55 is a section view of the fifth alternative embodiment of the broadhead with blades in an expanded mode.

As shown in FIG. 53, each ferrule slot 531 can be configured to include a first ferrule slot portion 531A and a second ferrule slot portion 531B. The first ferrule slot portion 531A can be configured to enable and provide the space and clearance within the ferrule 530 for the blade 540A to rearwardly deploy and generally move within that slot portion 531A. The second slot portion 531B can be configured to enable the second cutting blade 540B on the opposite side of the ferrule 530 to move at least partially therethrough. For example, when the broadhead is converted from a retracted mode to a deployed mode as shown in FIG. 55, or to an unbarbed mode from a deployed mode shown in FIGS. 56 and 57, the forward edge 542B and other portions of the blade 540B can pivot and move through the second slot portion 531B. The second slot portion of the respective ferrule slots optionally can provide adequate clearance for the blades to flip or translate from its position in the deployed mode to the unbarbed mode. Similar first and second ferrule slot portions can be disposed on the opposite side, or at some other predetermined location, of the ferrule to accommodate the other blade and its front edge during rotation or translation.

Optionally, the illustrated ferrule slot having different portions 531A and 531B is suitable particularly for the blades as illustrated, where the blade side surfaces 540C and 540D are configured to be placed side-by-side one another when the broadhead is assembled. For example, as shown in FIGS. 53 and 54, these side surfaces 540C and 540D are positioned immediately adjacent one another, and in some cases engage one another when the broadhead is assembled. In this configuration, the blades 540A and 540B are in a side-by-side configuration within at least a portion of the ferrule 530. Further, the blade connector portions 544A and 544B can be positioned side-by-side one another when joined with the carriage element 550.

The forward end 538 of the ferrule 530 can define a retaining element recess 570A as shown in FIG. 53. This recess can be of a size and depth to receive the retainer element base 571 and generally conceal that element from view to an observer of the broadhead when the penetrating end 520 is joined with the ferrule 530.

Figure 58:
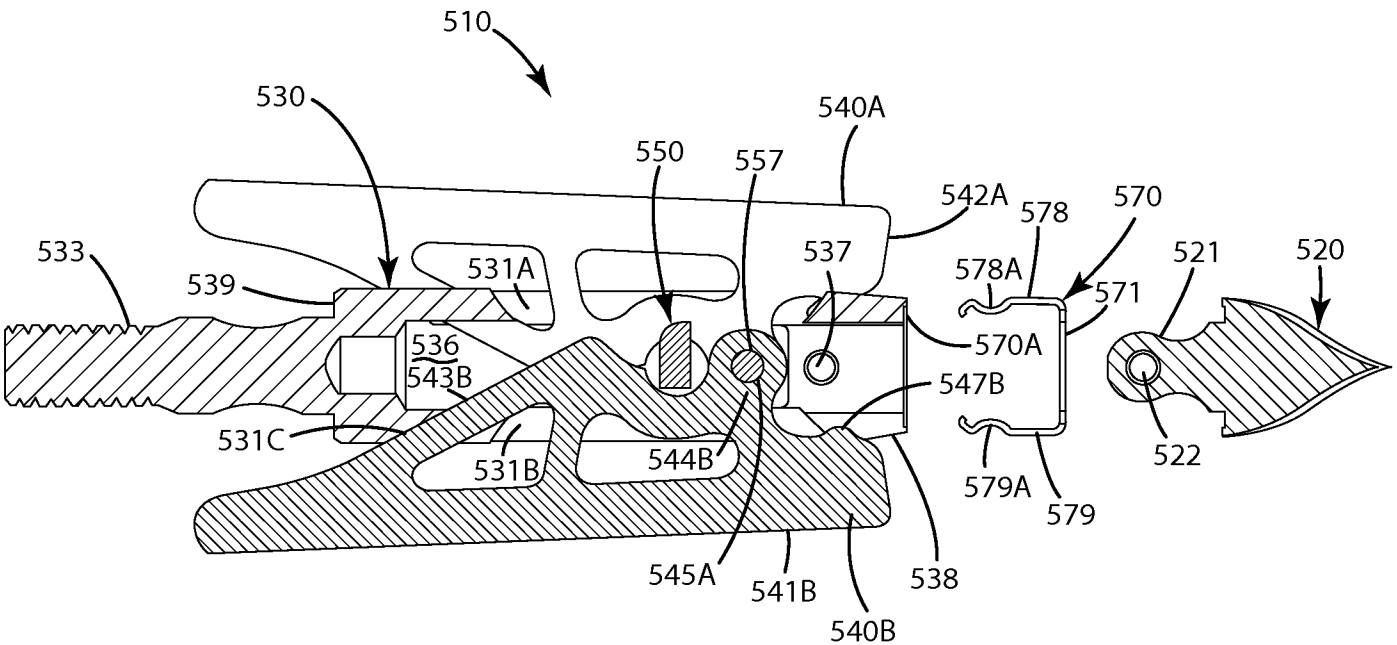
FIG. 58 is a section view of the broadhead of the fifth alternative embodiment with the penetrating tip and retainer element removed.
Figure 59:
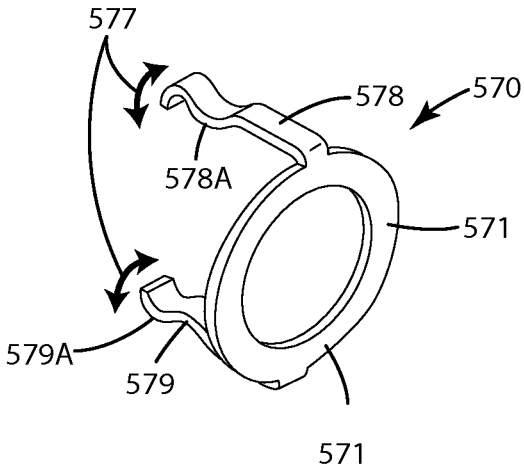
FIG. 59 is a perspective view of the retainer element of the fifth alternative embodiment of the broadhead.
Figure 60:
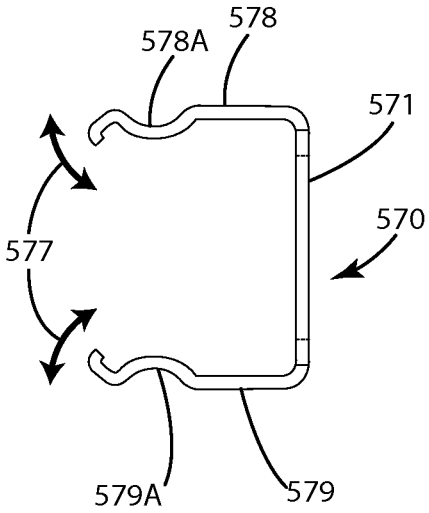
FIG. 60 is a side view of the retainer element of the fifth alternative embodiment of the broadhead.

Referring to FIGS. 53 and 58, the ferrule 530 is joined with a penetrating tip 520. The penetrating tip 520 can be detachable and/or removable from the ferrule 530, as with the embodiments above. If desired, the penetrating tip 520 can be integrally formed with the ferrule 530, with the stem 533 alternatively constructed so that the stem 533 is removable from the opposite end 539 of the ferrule to provide access to the bore 536.

The penetrating tip 520 can include sharpened edges as described in the embodiments above and may further include a base 521 extending rearwardly therefrom. The base 521 can include one or more tip holes, also referred to as fastener holes 522 that can extend through at least a portion of the base 521. These fastener holes 522 can optionally be threaded to receive fasteners 537A. The base 521 can be shaped and sized to fit at least partially within the bore 531 or otherwise be joined with the ferrule 530. For example, as shown in FIG. 54, the penetrating tip 520 includes a base 521 having a base perimeter 521A that fits within the bore 536 of the ferrule with a close enough tolerance to prevent any excessive wobble of the tip relative to the ferrule 530. The outer surfaces 523 of the base 521 (FIG. 53) can also be sized and shaped to match the inside dimensions and shape of the bore 536 to provide an additionally tight fit and/or locking action between the tip 520 and the ferrule 530.

As shown in FIG. 53, the ferrule can define fastener apertures 537 that extend from an exterior of the ferrule to the bore 536, optionally extending through the internal wall 532. These fastener apertures 537 can be countersunk so that corresponding fasteners 537A can be installed in the apertures without extending beyond the exterior of the ferrule 530. The fasteners 537A can be threaded into the corresponding fastener apertures 522 defined by the tip 520. As shown, there are fasteners on opposite sides of the ferrule to engage the penetrating tip 520 and hold it in place relative to the ferrule 530. Optionally, these opposing fasteners can be substituted with a single fastener extending all or part way through at least a portion of the base 521 of the tip 520. Alternatively, the fasteners could be replaced with a roll pin, a solid pin, or other construction to engage the tip and secure it in place at the end of the ferrule 530. In such a construction, however, the tip may or may not be removable from the remainder of the ferrule 530. If desired, this could limit access and replacement of the blades unless the bore 536 was otherwise accessible by removing other components of the ferrule 530, such as the stem 533.

The broadhead embodiment shown in FIGS. 53, 54, and 59-61 can include a retainer element 570. The retainer element can include a retainer base 571 that is joined with a first tang 578 and a second tang 579. The retainer base 571 can be in the form of a washer so that the base 521 of the penetrating tip 520 can fit through that retainer base 571 and extend into the bore 536 of the ferrule 530. The retainer element can be constructed from a metal, such as spring steel or other metal composite or polymeric structures. Optionally, the retainer element can be a stamped part, constructed from a metal, such as full hardness stainless steel. Further optionally, the material can be selected so that the first and second tangs 578 and 579 are resilient, that is, they can bend or flex in either of the directions of the arrows 577 and return generally to their original shape.

The tangs 578 and 579 can include projections or blade engaging portions 578A and 579A. These tang projections 578A and 579A are configured to engage the retainer element engagement portions 547A and 547B of the respective cutting blades 540. The projections 578A and 579A can be of a sufficient depth to capture the retainer element engagement portions 547A and 547B so as to hold the blades generally in the retracted mode.

Figure 61:
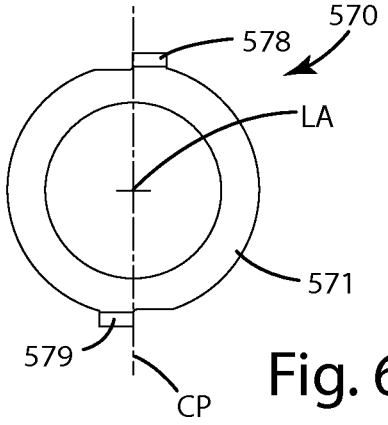
FIG. 61 is a top view of the retainer element of the fifth alternative embodiment.

As shown in FIG. 61, the tangs 578 and 579 can be opposed on opposite sides of the retainer element base 571. Further, the tangs 578 and 579 can be offset on opposite sides of a central plane CP that extends generally through the longitudinal axis LA of the retainer element, which corresponds to the longitudinal axis LA of the broadhead 510. With the tangs offset from the central plane CP, they can engage the first and second blades 540A and 540B, which also can be offset on opposite sides of the central plane CP that extends through the longitudinal axis LA of the broadhead 510 (FIG. 53).

Optionally, the side surfaces of the blades or other portions of the blades themselves can be immediately adjacent and/or at least partially aligned within the central plane CP of the broadhead. The central plane CP can generally bisect the broadhead into opposing halves. Of course, where more than two blades are included in the broadhead, the retainer element can include the corresponding number of tangs to engage the blades and retain them in a retracted mode and correspondingly, disengage the blades to allow them to expand to a deployed mode. For example, if there are three blades, there can be three tangs to engage the respective blades. Those three tangs can be equal distances from one another, for example, disposed at 120° from one another about the longitudinal axis LA.

The blades 540, and in particular, the first blade 540A and the second blade 540B generally include an outer cutting edge 541A, 541B and an inner edge 543A, 543B which are connected via the forward edge 542A, 542B. Each blade can include blade side surfaces 540C and 540D. The blades also can include connector portions 544A and 544B. These connector portions can be configured to join the respective blades with the connector body 550. As illustrated in FIGS. 53 and 54, the connector portions define apertures 545A and 545B. Generally, these apertures are configured to receive the carriage pin 557 of the carriage element 550 through them.

Optionally, the size and shape of the blade apertures 545A and 545B are precisely matched to correspond to the exterior of the carriage pin so that the only motion between the blades 540 and the pin 557 is a pivoting or rotating motion. Further optionally, the connector portions 544A and 544B, and generally the blades 540, do not slide or move, other than in a substantially pivoting or rotating motion about the carriage pin 557. This can be suitable particularly where it is helpful to precisely and exactly transitioning the blades from the retracted mode to the deployed mode. Of course, instead of including the aperture 545A and 545B, one or both of the blades 540 can include a projection, such as a boss or integral pin that extends therefrom. That pin can further extend into the other blade and/or the carriage element (not shown).

As described above, the blades 540A and 540B can include retainer element engagement portions 547A and 547B. As illustrated, those engagement portions can be constructed as rounded projections extending from a forward portion of the blades. If desired, these rounded portions instead can be in the form of detents or depressions in the forward portion of the blade, and the tangs of the retainer element could instead have rounded or curved portions that extend into the depressions or recesses, as in the embodiments above.

Optionally, adjacent at the forward end of the respective blades, for example, near the connector portions, each blade can define an anti-barbing recess 549A and 549B, which can further cooperate with the second ferrule slot portion 531B to enable the respective blades to translate to an unbarbed mode from a deployed mode, which generally puts the broadhead in a barbed configuration that is difficult to remove from a target because the rearward portions of the blades dig into the target. As an example, the anti-barbing recess 549A enable the blades 540A and 540B to rotate about the carriage pin 557 from the barbed, deployed mode shown in FIG. 55 to the unbarbed modes of FIGS. 56 and 57, as described in more detail below.

Referring to FIG. 54, the retaining element 570 can engage the blades 540 to hold them in a retracted mode. For example, the respective tang 578B of the retainer element 570 can be resiliently biased in the retracted mode against the forward portion of the blade 540B, and in particular, the retainer element engagement portion 547B. Specifically, the tang 578B can exert a retainer force RF against the front of the blade at the portion 547B. In turn, this can exert a moment M1 about the pivot pin 557. This moment M1 can generate a locking force LF which engages the inner edge 543B of the blade 540B against the ferrule slot surface 531C. As long as the tang 578B engages and exerts the retainer force RF against the retainer element engagement portion 547, the blade remains in a locked and retracted mode. As described in the operation of the broadhead below, when the blades are sufficiently pushed rearward so that the tangs disengage the retainer element engagement portions, the carriage element 550 and blades 540 are free to translate from the retracted mode shown in FIG. 54 to the deployed mode shown in FIG. 55.

Returning to the connector body, which is formed as a carriage element 550 in FIGS. 53 and 54, this component defines a carriage void 553 generally extending from the first end 551 toward the second end 552 of the carriage element. The second end 552 of the carriage element 550 can be and can connect the opposing carriage sides 556 and 557 located on opposite sides of the void 553. The opposing carriage sides 556 and 557 of the carriage element can generally include or define a carriage pin aperture 555. As mentioned above, this carriage pin aperture 555 closely corresponds to the size and dimension of the carriage pin 557. Optionally, the diameters of the aperture 555 and the pin 557 are such that when the pin is installed in the aperture 555 it can be immovable and non-rotatable relative to the carriage element 550, or more generally, non-removable from the carriage element, at least when installed in the bore 536.

As further illustrated, the carriage element 550 can be configured as an elongated body that has a length along the longitudinal axis LA of the broadhead 510 that is greater than the width or diameter of the carriage element 550. Optionally, the carriage element can define the extension void 554 at the ends of the carriage void 553 to accommodate a portion of the inner edge of the respective blades.

Operation of the fifth alternative embodiment of the broadhead 510 will now be described with reference to FIGS. 53-58. The ferrule 530 can be provided with its bore 536 defined along a longitudinal axis LA. The ferrule slots 531 can be defined in the ferrule and generally can extend from the bore 536 through the internal wall 532 to an exterior of the ferrule 530. The ferrule slots 531 can include the first and second slot portions to accommodate the respective first and second cutting blades 541A and 541B as described above. The blades 540A and 540B can be constructed, for example, via a stamping process to include the features described above.

The connector portions 544A and 544B of the blades 540 defining the respective carriage pin apertures 545A and 545B can be aligned with one another. These connector portions can be placed in the carriage element void 553 of the carriage element 550. The apertures 545A and 545B can be further aligned with the carriage pin aperture 555. Upon such alignment, the carriage pin 557 can be inserted through the apertures 545A and 545B. With this connection, the blades 540 are configured so that they can pivot about the pin 557. In this assembled state, the blades 540 and carriage element 550 can form a blade connector assembly or unit.

The blade connector assembly, and in particular the carriage element 550 and portions of the blades, is inserted in the ferrule bore 536. The carriage element 550 is slid downward toward the second end 539 of the ferrule within the bore 536. The blades 540A and 540B can register with the respective ferrule slots 531. For example, the blade 540A as shown in FIG. 53 registers with the first ferrule slot portion 531A. The blades are moved downward until their inner edges 543A engage the rearward portion of the ferrule slots 531C. With the blade connector assembly installed, the blades generally project outwardly away from the longitudinal axis LA so that the outer cutting edges 541A and 541B face outward relative to that longitudinal axis LA, and the inner edges 543A and 543B face inward toward the longitudinal axis LA. Further, the blades 541A and 541B can be disposed on opposite sides of a central plane CP of the ferrule 530. Generally, the slots 531 also can be disposed on opposite sides of this plane, and in particular, the first ferrule slots. Of course, where there is enough clearance, these blades can lies at least partially within the same central plane CP.

As shown in FIGS. 53 and 58, the penetrating tip 520 and retainer element 570 can be installed. The retainer element 570 can be positioned and joined with the ferrule so that the base 571 fits within the retainer element recess 570A. The tangs 578 and 579 can be positioned in the ferrule slots 531, and more particularly, the first ferrule slot portions, for example, tang 578 can be positioned at least partially in the first ferrule slot portion 531A. The projections 578A and 579A recesses of the retainer element 570 can be engaged against the respective retainer element engagement portions 547A and 547B of the respective blades 540A and 540B. As described above in connection with FIG. 54, the blades 540A and 540B can be effectively locked in a retracted mode via the engagement of the retainer element with the blades.

The base 521 of the penetrating tip 520 can be inserted within the ferrule bore 536 so that the tip holes 522 align with the ferrule holes 537. The fasteners 537A can be threaded through the ferrule holes and/or the tip holes to secure the penetrating tip 520 to the ferrule 530.

With the penetrating tip installed, the broadhead 510 can be configured in the retracted mode as shown in FIG. 54. There, as illustrated, the carriage element 550 is generally disposed a distance D1 from the penetrating tip 520. Further, the blades 540 are temporarily locked in place as described above by way of the retainer element 570 engaging the blades 540.

The broadhead can be installed on a projectile, such as an arrow, in the illustrated retracted mode and shot with the arrow. When the broadhead 510 impacts a target, the penetrating tip 520 pierces the target. The target engages the front edges 542A and 542B. From there, the broadhead 510 is converted from the retracted mode to the deployed or expanded mode as shown in FIG. 55. In doing so, the blades 540A and 540B generally move rearward, sliding within the respective ferrule slots, and in particular, the first ferrule slot portions of the respective ferrule slots 531. The carriage element 550 also slides rearwardly within the bore 536 during this rearward movement from the retracted mode to the deployed mode. Likewise, the portions of the blade, for example, the connector portions 544A and 544B, also move rearward within the bore 536.

Generally, the carriage element 550 moves from the distance D1 in the retracted mode (FIG. 54) to a distance D2 (FIG. 55). Distance D2 is greater than distance D1 as measured from the penetrating tip 520. As mentioned above, the carriage element 550 and penetrating tip 520 optionally can be separate elements, so the carriage element can move away from the penetrating tip 520 as illustrated.

As further shown in FIG. 55, during the rearward movement of the blade connector assembly, the inner edges 543A and 543B of the blades engage the rearward portions of the ferrule slots 531C and move the blades outward. In turn, this moves the outer cutting edges 541A and 541B even further outward from the longitudinal axis LA to increase the cutting diameter of the broadhead 510. Throughout the translation from the retracted mode to the deployed mode, the outer cutting edges 541A and 541B generally face outward and away from the longitudinal axis LA.

The carriage element 550 can continue moving away from the penetrating tip 520 until the blades 540 are fully deployed. Optionally, the full deployment of the blades 540 can be achieved when the carriage element 550 engages the bottom 536B of the bore 536, or some other stop located in the bore or associated with the carriage element.

As mentioned above, the broadhead 510 of the fifth alternative embodiment optionally can include features that enable it to convert from the deployed mode to an unbarbed mode. For example, in the deployed mode, the blades can be barb-like, which can impair the removal of the broadhead 510 from the target. To facilitate removal, the broadhead can include the components and features described above to enable it to convert from the deployed mode shown in FIG. 55, to the unbarbed mode shown in FIGS. 56 and 57. Optionally, the total deployed diameter TD1 of the broadhead 510, including that provided by the blades 540 shown in FIG. 55, is reduced to the smaller, unbarbed total diameter TD2 shown in FIG. 57.

Generally, when converting from the deployed mode to the unbarbed mode, the blades 540 flip forward toward the penetrating tip 520. The cutting edges 541A and 541B can be flipped inward so that they face the longitudinal axis LA as shown in FIG. 57. The forward edges, for example, 542A of the blades 540 also can flip so that they face rearward, for example, toward the rear end 539 of the ferrule 530.

After the broadhead 510 is fully removed from the target, the blades can be reconfigured back to the retracted mode as shown in FIG. 54. In the embodiment illustrated there, with the components of the retainer element 570 generally being disposed substantially within the ferrule and/or the ferrule slots, those elements generally can be protected from damage due to impact with the target. Therefore, the retainer element is usually reusable so that the blades can re-engage the retainer element and be locked into the retracted mode for repeated use of the broadhead 510.

The above descriptions are those of the preferred embodiments of the invention. Various alterations and changes can be made without departing from the spirit and broader aspects of the invention as defined in the appended claims, which are to be interpreted in accordance with the principles of patent law including the doctrine of equivalents. Any references to claim elements in the singular, for example, using the articles "a," "an," "the," or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. An archery broadhead comprising:

a ferrule including a first end and a second end opposite the first end, the ferrule defining a bore extending between the first end and the second end, the bore bounded at least partially by an internal wall;

a penetrating tip joined with the ferrule;

a first ferrule slot and a second ferrule slot, each defined by the ferrule extending from the bore to an exterior surface of the ferrule;

a carriage element slidably disposed within the bore of the ferrule, the carriage element moveable away from the penetrating tip, the carriage element being an elongated body extending from a first carriage element end to a second carriage element end, the carriage element defining a void extending from the first carriage element end toward the second carriage element end;

a first cutting blade and a second cutting blade, each including a connector portion with an aperture defined by the connector portion, the connector portions of the first cutting blade and the second cutting blade positioned side by side and overlapping one another in the void, the first cutting blade and the second cutting blade extending from within the bore outward through the first ferrule slot and the second ferrule slot, respectively;

a carriage pin extending through the apertures of the first cutting blade and the second cutting blade to pivotally join the first cutting blade and the second cutting blade with the carriage element, the carriage pin joined with the carriage element;

whereby the first and second cutting blades are configured to move in unison with one another, each generally pivoting about the carriage pin, and each moving with the carriage element, from a retracted mode to a deployed mode upon impact with a target.

2. The archery broadhead of claim 1 wherein the penetrating tip is at least one of integrally formed with the ferrule, and a separate tip unit including a base positioned within the bore and joined with the ferrule via a fastener.

3. The archery broadhead of claim 2 wherein the separate tip unit defines a tip hole, and wherein the ferrule defines a fastener hole through which the fastener projects, wherein the fastener engages the tip hole to removably secure the separate tip unit to the ferrule.

4. The archery broadhead of claim 1 comprising a retainer element including first and second tangs that engage the first and second cutting blades to retain the first and second cutting blades in a retracted mode.

5. The archery broadhead of claim 4 wherein the first and second tangs are located in the ferrule.

6. The archery broadhead of claim 4 wherein the first and second cutting blades each include a blade projection that respectively engages the first and second tangs.

7. The archery broadhead of claim 4 wherein the retaining spring defines a central plane, wherein the first and second tangs are offset from one another and positioned on opposite sides of the central plane.

8. The archery broadhead of claim 1 wherein the bore is cylindrical, and the carriage element is cylindrical from the first carriage element end toward the second carriage element end.

9. The archery broadhead of claim 1 wherein the elongated body of the carriage element has a length extending in alignment with the longitudinal axis, and a width extending transverse to the longitudinal axis, the length being greater than the width whereby the elongated body engages the bore during movement to the deployed mode to stabilize movement of the first and second cutting blades.

10. The archery broadhead of claim 1 wherein the first and second cutting blades are pivotable about the carriage pin from the deployed mode to a unbarbed mode upon the broadhead being withdrawn from the target.

11. The archery broadhead of claim 1 wherein the blades pivot, but do not slide, relative to the carriage pin, and wherein the carriage pin is immovably fixed relative to the carriage element.

12. An archery broadhead comprising:

a ferrule including a first end and a second end opposite the first end, the ferrule defining a bore extending between the first end and the second end, the bore bounded at least partially by an internal wall;

a penetrating tip joined with the ferrule;

a connector body slidably disposed within the bore of the ferrule and generally concealed from view within the bore, the connector body moveable away from the penetrating tip, the connector body being at least one of a pin and a carriage element having an elongated body; and a first cutting blade and a second cutting blade, each extending from within the bore outward through the internal wall to a location exterior of the ferrule;

wherein the connector body is pivotally joined with the first cutting blade and the second cutting blade within the bore;

whereby the first and second cutting blades move rearward from the penetrating tip in unison with one another and the carriage element from a retracted mode to a deployed mode upon impact with a target, wherein the penetrating tip is removable from the ferrule, wherein a retainer element is joined with the ferrule, the retainer element including a tang that extends rearwardly away from the penetrating tip, the tang including an engagement portion that resiliently engages the first cutting blade to hold the first cutting blade in the retracted mode.

13. An archery broadhead comprising:

a ferrule including a first end and a second end opposite the first end, the ferrule defining a bore extending between the first end and the second end, the bore bounded at least partially by an internal wall;

a penetrating tip joined with the ferrule;

a connector body slidably disposed within the bore of the ferrule and generally concealed from view within the bore, the connector body moveable away from the penetrating tip, the connector body being at least one of a pin and a carriage element having an elongated body; and a first cutting blade and a second cutting blade, each extending from within the bore outward through the internal wall to a location exterior of the ferrule;

wherein the connector body is pivotally joined with the first cutting blade and the second cutting blade within the bore;

whereby the first and second cutting blades move rearward from the penetrating tip in unison with one another and the carriage element from a retracted mode to a deployed mode upon impact with a target; and a retainer element having a resilient tang, the resilient tang being concealed from view by the first cutting blade when the first cutting blade is in the retracted mode.

14. An archery broadhead comprising:

a ferrule including a first end and a second end opposite the first end, the ferrule defining a bore extending between the first end and the second end, the bore bounded at least partially by an internal wall;

a penetrating tip joined with the ferrule;

a connector body slidably disposed within the bore of the ferrule and generally concealed from view within the bore, the connector body moveable away from the penetrating tip, the connector body being at least one of a pin and a carriage element having an elongated body; and a first cutting blade and a second cutting blade, each extending from within the bore outward through the internal wall to a location exterior of the ferrule;

wherein the connector body is pivotally joined with the first cutting blade and the second cutting blade within the bore;

whereby the first and second cutting blades move rearward from the penetrating tip in unison with one another and the carriage element from a retracted mode to a deployed mode upon impact with a target, wherein the ferrule has a longitudinal axis, wherein the connector body is the pin, and the pin is a straight, linear pin that extends perpendicular to the longitudinal axis, wherein the pin extends across at least a portion of the bore, wherein the pin moves with the first and second cutting blades away from the penetrating tip when the first and second cutting blades move from the retracted mode to the extended mode.

15. An archery broadhead comprising:

a ferrule including a first end and a second end opposite the first end, the ferrule defining a bore extending between the first end and the second end, the bore bounded at least partially by an internal wall;

a penetrating tip joined with the ferrule;

a connector body slidably disposed within the bore of the ferrule and generally concealed from view within the bore, the connector body moveable away from the penetrating tip, the connector body being at least one of a pin and a carriage element having an elongated body; and a first cutting blade and a second cutting blade, each extending from within the bore outward through the internal wall to a location exterior of the ferrule;

wherein the connector body is pivotally joined with the first cutting blade and the second cutting blade within the bore;

whereby the first and second cutting blades move rearward from the penetrating tip in unison with one another and the carriage element from a retracted mode to a deployed mode upon impact with a target, wherein the connector body is the carriage element having the elongated body, wherein the elongated body defines a carriage recess, the carriage recess bounded by a carriage recess wall, wherein a projection extends from the carriage recess wall, wherein the projection registers with at least one aperture defined by the first cutting blade so as to pivotally join the first cutting blade with the carriage element.

16. An archery broadhead comprising:

a ferrule including a first end and a second end opposite the first end, the ferrule defining a bore extending between the first end and the second end, the bore bounded at least partially by an internal wall;

a penetrating tip joined with the ferrule;

a connector body slidably disposed within the bore of the ferrule and generally concealed from view within the bore, the connector body moveable away from the penetrating tip, the connector body being at least one of a pin and a carriage element having an elongated body; and a first cutting blade and a second cutting blade, each extending from within the bore outward through the internal wall to a location exterior of the ferrule;

wherein the connector body is pivotally joined with the first cutting blade and the second cutting blade within the bore;

whereby the first and second cutting blades move rearward from the penetrating tip in unison with one another and the carriage element from a retracted mode to a deployed mode upon impact with a target, wherein the connector body is the carriage element having the elongated body, wherein the elongated body includes a first end and a second end, wherein the elongated body defines a carriage void, wherein the first cutting blade includes a connector portion that is positioned within the carriage void, wherein the connector portion of the first cutting blade is joined with a carriage pin to the elongated body of the connector body slidably disposed within the bore of the ferrule.

17. The archery broadhead of claim 16 wherein the carriage void extends from the first end toward the second end of the elongated body, wherein the carriage pin is fixedly and immovably joined with the elongated body between the first end and the second end of the elongated body.

18. An archery broadhead comprising:

a ferrule including a longitudinal axis and a bore;

a penetrating tip joined with the ferrule;

a connector body positioned within the bore, distal from the penetrating tip, and slidable within the bore away from the penetrating tip;

a first cutting blade and a second cutting blade pivotally joined with the connector body, the first cutting blade and the second cutting blade each including cutting edges that face outward generally away from the longitudinal axis in both a retracted mode and a deployed mode, the first cutting blade and the second cutting blade each including inner edges opposite the cutting edges, the inner edges facing inward generally toward the longitudinal axis in both the retracted mode and the deployed mode; and a retainer element disposed at least partially within the ferrule, the retainer element resiliently engaging the inner edge of the first cutting blade to temporarily maintain the first cutting blade in the retracted mode.

19. The archery broadhead of claim 18 wherein the retainer element is concealed at least partially within the ferrule, wherein the retainer element is positioned forward of the connector body, wherein the retainer element includes a tang, wherein the first cutting blade includes a front end and a rear end, wherein the tang engages the front end of the first cutting blade and a portion of the ferrule engages the rear end of the first cutting blade to retain the first cutting blade in the retracted mode.

20. The archery broadhead of claim 18 wherein the first cutting blade and the second cutting blade are pivotable about the connector body from the deployed mode to an unbarbed mode whereby the broadhead is removable from a target.

21. A method of operating a broadhead comprising:

defining a bore in a ferrule along a longitudinal axis, the bore bounded at least partially by an internal wall, defining first and second ferrule slots in the ferrule extending from the bore through the internal wall to an exterior of the ferrule;

pivotally joining a connector body, being at least one of a pin and an elongated body, with a first cutting blade and a second cutting blade to form a blade connector assembly;

sliding the blade connector assembly in the bore of the ferrule;

positioning the first cutting blade and the second cutting blade so that each extend from within the bore outward through the first and second ferrule slots respectively;

attaching at least one of a penetrating tip and a stem to the ferrule to close at least a portion of the bore;

moving the blade connector assembly away from the penetrating tip, the first and second cutting blades moving in unison with one another and with the connector body from a retracted mode to a deployed mode.

22. The method of claim 21 wherein the first cutting blade and the second cutting blade each include a blade side surface, comprising positioning the blade side surface of the first cutting blade and the blade side surface of the second cutting blade side by side and overlapping one another in the bore.

23. The method of claim 22 wherein the connector body is an elongated, straight pin, and comprising placing the pin through an aperture defined by the first cutting blade.

24. The method of claim 21 wherein the connector body is a carriage element including an elongated body and defining at least one of a carriage void and a carriage recess, comprising placing a portion of the first cutting blade in the at least one of the carriage void and the carriage recess, and joining the first cutting blade with the carriage element.

25. The method of claim 24 wherein the carriage element includes the elongated body and defines the carriage void, comprising placing a carriage pin through aligned apertures defined by the first cutting blade, the second cutting blade, and the elongated body to join the first cutting blade and the second cutting blade with the elongated body.

26. The method of claim 24 wherein the carriage element includes the elongated body and defines the carriage recess, wherein the carriage recess is bounded by a carriage recess wall, wherein a projection extends from the carriage recess wall, comprising placing the projection through an aperture defined by the first cutting blade to join the first cutting blade with the elongated body.

27. The method of claim 21 comprising pivoting the first cutting blade and the second cutting blade relative to the connector body so that the first cutting blade and the second cutting blade convert from the deployed mode to an unbarbed mode.

* * * * *